US008953000B2

(12) United States Patent
Saitoh et al.

(10) Patent No.: US 8,953,000 B2
(45) Date of Patent: Feb. 10, 2015

(54) LIQUID CRYSTAL DISPLAY AND METHOD OF DRIVING LIQUID CRYSTAL DISPLAY

(75) Inventors: Yukito Saitoh, Minami-Ashigara (JP); Hiroshi Sato, Minami-Ashigara (JP); Rikio Inoue, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 211 days.

(21) Appl. No.: 13/616,363

(22) Filed: Sep. 14, 2012

(65) Prior Publication Data

US 2013/0083091 A1 Apr. 4, 2013

(30) Foreign Application Priority Data

Sep. 30, 2011 (JP) ..... 2011-218158
Jun. 14, 2012 (JP) ..... 2012-134571

(51) Int. Cl.
*G09G 5/10* (2006.01)
*G09G 3/36* (2006.01)

(52) U.S. Cl.
CPC ..... *G09G 3/36* (2013.01); *G09G 3/3607* (2013.01); *G09G 2300/0452* (2013.01); *G09G 2320/0271* (2013.01); *G09G 2320/028* (2013.01); *G09G 2340/06* (2013.01)
USPC ..... 345/690

(58) Field of Classification Search
USPC ..... 345/690–692; 349/114; 348/743
See application file for complete search history.

(56) References Cited

U.S. PATENT DOCUMENTS 5,929,843 A 7/1999 Tanioka
2002/0024618 A1* 2/2002 Imai ..... 348/743
2008/0043188 A1* 2/2008 Zhu et al. ..... 349/114

FOREIGN PATENT DOCUMENTS

JP 5-241551 A 9/1993

* cited by examiner

*Primary Examiner* — Premal Patel
(74) *Attorney, Agent, or Firm* — Birch, Stewart, Kolasch & Birch, LLP

(57) ABSTRACT

A liquid crystal display where grayscale inversion is reduced includes a liquid crystal cell having pixel groups, each group comprising a red (R) pixel, a green (G) pixel, a blue (B) pixel, and a white (W) pixel, and drive circuitry that applies a voltage $V_{RGB}$ and a voltage $V_W$ satisfying the formulae (ia) and (iia) between electrodes defining the G pixel and between electrodes defining the W pixel, respectively, depending on a grayscale level L (where L satisfies $0 \le L \le 1$) in grayscale where substantially the same voltage $V_{RGB}$ is applied between electrodes defining each of the R, G, and B pixels:

$$\text{for } 0 < L \le 0.03,\ T_G = 0 \text{ and } T_W = 2*L, \quad \text{(ia)}$$

$$\text{for } 0.03 < L \le 0.3,\ 0.05 < T_W/(T_G - 0.03) < 0.86; \quad \text{(iia)}$$

where $T_G$ and $T_W$ each represent normalized transmittance obtained through normalization of transmittance of each of the G and W pixels assuming that white brightness in a normal direction to a display surface of the liquid crystal display is 1.

13 Claims, 9 Drawing Sheets
(2 of 9 Drawing Sheet(s) Filed in Color)

LIQUID CRYSTAL DISPLAY AND METHOD OF DRIVING LIQUID CRYSTAL DISPLAY

CROSS-REFERENCE TO RELATED APPLICATIONS

The present application claims the benefit of priority from Japanese Patent Application No. 218158/2011, filed on Sep. 30, 2011, and Japanese Patent Application No. 134571/2012 filed on Jun. 14, 2012, the contents of which are herein incorporated by reference in their entirety.

BACKGROUND OF THE INVENTION

1. Field of the Invention

The present invention relates to a high-brightness liquid crystal display exhibiting reduced, downward grayscale inversion, and a method of driving the liquid crystal display.

2. Description of the Related Art

RGBW liquid crystal displays have been proposed as high-brightness liquid crystal displays, for example, as is disclosed in JP-A-05-241551. The RGBW liquid crystal display includes pixels of four RGBW colors for color display. Specifically, the RGBW liquid crystal display has white (W) pixels in addition to RGB pixels, exhibiting an increase in brightness in a normal direction (hereinafter, referred to as front direction) to a display surface compared with the typical RGB liquid crystal display. If the RGBW liquid crystal display is applied to a TN liquid crystal display having high transmittance, such an advantage is expected to be further enhanced.

The TN liquid crystal display, however, has a disadvantage of downward grayscale inversion. An optically-compensatory film is typically used to compensate for residual retardation during black display, so that grayscale inversion is somewhat reduced.

SUMMARY OF THE INVENTION

An object of the present invention is to solve the above-described problem.

In detail, the object of the invention is to eliminate downward grayscale inversion without impairing high transmittance of the RGBW liquid crystal display.

[1] A liquid crystal display, comprising:

a pair of polarizers;

a liquid crystal cell comprising a pair of substrates having electrodes defining pixels on at least one of opposed surfaces of the substrates, and a liquid crystal layer disposed between the pair of substrates, the liquid crystal layer being twist-aligned at a twist angle of 90° or less; and retardation films each being disposed between each of the pair of polarizers and the liquid crystal cell, the liquid crystal cell having pixel groups, each group comprising a red (R) pixel, a green (G) pixel, a blue (B) pixel, and a white (W) pixel, the liquid crystal display further comprising drive means that applies a voltage $V_{RGB}$ and a voltage $V_W$ satisfying the formulae (ia) and (iia) or (ib) and (iib) between electrodes defining the G pixel and between electrodes defining the W pixel, respectively, depending on a grayscale level L (where L satisfies $0 \le L \le 1$) in grayscale where substantially the same voltage $V_{RGB}$ is applied between electrodes defining each of the R, G, and B pixels:

$$\text{for } 0<L\le 0.03,\ T_G=0 \text{ and } T_W=2*L, \quad \text{(ia)}$$

$$\text{for } 0.03<L\le 0.3,\ 0.05<T_W/(T_G-0.03)<0.86; \quad \text{(iia)}$$

$$\text{for } 0<L\le 0.03,\ T_W=0 \text{ and } T_G=2*L, \quad \text{(ib)}$$

$$\text{for } 0.03<L\le 0.3,\ 0.05<T_G/(T_W-0.03)<0.86, \quad \text{(iib)}$$

where $T_G$ and $T_W$ each represent normalized transmittance obtained through normalization of transmittance of each of the G and W pixels assuming that white brightness in a normal direction to a display surface of the liquid crystal display is 1.

[2] The liquid crystal display of [1], wherein the retardation film is a laminated film comprising a support and an optically-anisotropic layer comprising discotic liquid crystal fixed in a hybrid alignment state.

[3] The liquid crystal display of [1] or [2], wherein the twist angle of the liquid crystal layer is 90°.

[4] The liquid crystal display of any one of [1] to [3], wherein the liquid crystal display comprises a backlight unit comprising a surface light source and a condenser sheet, and when the quantity of light emitted from the backlight unit is measured, the average quantity of light at an output angle in a range of 50° to 85° is 12% or less of the quantity of light in a normal direction to a screen of the liquid crystal display, the output angle tilting toward a vertical or horizontal direction on the screen of the liquid crystal display with respect to the normal to the screen of the liquid crystal display as viewed from a viewer.

[5] The liquid crystal display of [1] to [4], wherein the retardation film comprises a single polymer film, and a refractive index nx in an in-plane maximum direction, a refractive index ny in a direction perpendicular to nx, and a refractive index nz in a thickness direction satisfy nx>ny>nz.

[6] The liquid crystal display of [4] or [5], wherein the condenser sheet is a prism sheet having convex portions facing the liquid crystal cell.

[7] A method of driving a liquid crystal display comprising a pair of polarizers, a liquid crystal cell comprising a pair of substrates having electrodes defining pixels on at least one of opposed surfaces of the substrates, and liquid crystal layer disposed between the pair of substrates, the liquid crystal layer being twist-aligned at a twist angle of 90° or less, and retardation films each being disposed between each of the pair of polarizers and the liquid crystal cell, the liquid crystal cell having pixel groups, each group comprising a red (R) pixel, a green (G) pixel, a blue (B) pixel, and a white (W) pixel, wherein a voltage $V_{RGB}$ and a voltage $V_W$ satisfying the formulae (ia) and (iia) or (ib) and (iib) are applied between electrodes defining the G pixel and between electrodes defining the W pixel, respectively, depending on a grayscale level L (where L satisfies $0 \le L \le 1$) in grayscale where substantially the same voltage $V_{RGB}$ is applied between electrodes defining each of the R, G, and B pixels:

$$\text{for } 0<L\le 0.03,\ T_G=0 \text{ and } T_W=2*L, \quad \text{(ia)}$$

$$\text{for } 0.03<L\le 0.3,\ 0.05<T_W/(T_G-0.03)<0.86; \quad \text{(iia)}$$

$$\text{for } 0<L\le 0.03,\ T_W=0 \text{ and } T_G=2*L, \quad \text{(ib)}$$

$$\text{for } 0.03<L\le 0.3,\ 0.05<T_G/(T_W-0.03)<0.86, \quad \text{(iib)}$$

where $T_G$ and $T_W$ each represent normalized transmittance obtained through normalization of transmittance of each of the G and W pixels assuming that white brightness in a normal direction to a display surface of the liquid crystal display is 1.

According to the invention, downward grayscale inversion can be eliminated without impairing high transmittance of the RGBW liquid crystal display.

BRIEF DESCRIPTION OF THE DRAWINGS

The patent or application file contains at least one color drawing. Copies of this patent or patent application publication with color drawing will be provided by the USPTO upon request and payment of the necessary fee.

FIG. 1-2 illustrates an exemplary three-dimensional map used for description of the driving method according to the invention, the map showing a relationship between contribution rate of each of the grayscale level $L_G$ of a G pixel and the grayscale level $L_W$ of a W pixel and transmittance of another exemplary RGBW TN-mode liquid crystal display.

FIG. 1-3 illustrates an exemplary three-dimensional map used for description of the driving method according to the invention, the map showing a relationship between contribution rate of each of the grayscale level $L_G$ of a G pixel and the grayscale level $L_W$ of a W pixel and transmittance of another exemplary RGBW TN-mode liquid crystal display.

FIG. 2 is an exemplary graph used for description of the driving method according to the invention, the graph showing a relationship between the grayscale level and normalized transmittance.

FIG. 3-1 is a schematic sectional view of an exemplary liquid crystal display of the invention.

FIG. 3-2 is a detailed schematic sectional view of an exemplary liquid crystal display of the invention.

FIG. 3-3 is a schematic sectional view of another exemplary liquid crystal display of the invention.

FIG. 4-1 is a schematic top view of an exemplary RGBW color filter usable in the invention.

FIG. 4-2 is a schematic top view of an exemplary RGBW color filter and liquid crystal display pixels which are driven by drive circuitry in accordance with the invention.

FIG. 6-1 is a schematic view of a backlight unit of the liquid crystal display including a surface light source and a condenser sheet in accordance with the invention.

FIG. 6-2 is a sectional view showing an exemplary optical path in an optical sheet.

BEST MODE FOR CARRYING OUT THE INVENTION

The invention is described in detail hereinunder. In this description, the numerical range expressed by the wording "a number to another number" means the range that falls between the former number indicating the lowermost limit of the range and the latter number indicating the uppermost limit thereof. First described are the terms used in this description.

Throughout the specification, the polar angle is defined as an inclination angle from a normal direction to a display surface, and the rightward, upward, leftward, and downward directions of a screen are defined as azimuths of 0°, 90°, 180°, and 270°, respectively. Thus, "downward direction" refers to a direction with an azimuth of 270°. For example, "downward 30°" refers to a direction with an azimuth of 270° and a polar angle of 30°.

The liquid crystal display of the present invention is an RGBW TN-mode liquid crystal display, in which a pixel group of a liquid crystal cell consists of a red (R) pixel, a green (G) pixel, a blue (B) pixel, and a white (W) pixel, the liquid crystal display including a drive voltage means that determines the voltage to be applied between electrodes defining each pixel depending on a grayscale level L (where L satisfies $0 \leq L \leq 1$) in grayscale where substantially the same voltage $V_{RGB}$ is applied between electrodes defining each of the R, G, and B pixels, and applies the determined voltage to each pixel. The grayscale is achromatic grayscale. In other words, substantially the same voltage $V_{RGB}$ is applied between the electrodes defining each of the R, G, and B pixels. Although the driving means and the driving method according to the invention are described below with reference to a voltage applied between the electrodes defining each of the G and W pixels, the following relationship is also effective for the R or B pixel in place of the G pixel.

The substantially same voltage refers to voltages having a difference of ±1 V or less therebetween.

The present invention is characterized in that the relationship between the contribution rate of each of the grayscale level $L_G$ of the G pixel and the grayscale level $L_W$ of the W pixel to a grayscale level L and the transmittance is expressed with a three-dimensional map, so that the path of a variation in grayscale along which grayscale inversion occurs is predicted, and a voltage to be applied between the electrodes defining each of the G and W pixels is determined depending on the grayscale level L such that the path is avoided.

Figure 1:
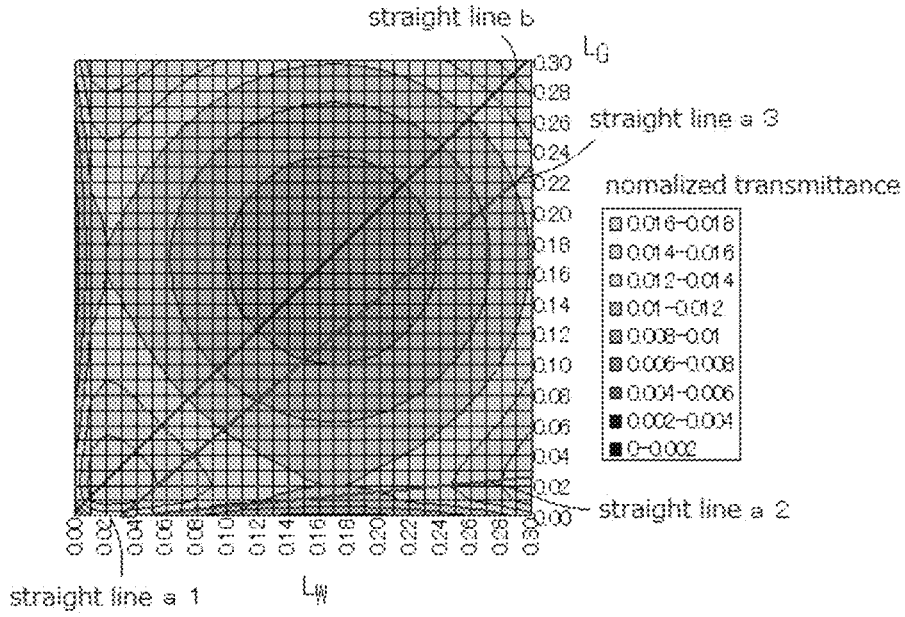
FIG. 1-1 illustrates an exemplary three-dimensional map used for description of a driving method according to the present invention, the map showing a relationship between contribution rate of each of the grayscale level $L_G$ of a G pixel and the grayscale level $L_W$ of a W pixel and transmittance of an exemplary RGBW TN-mode liquid crystal display.
Figures 1, 2:
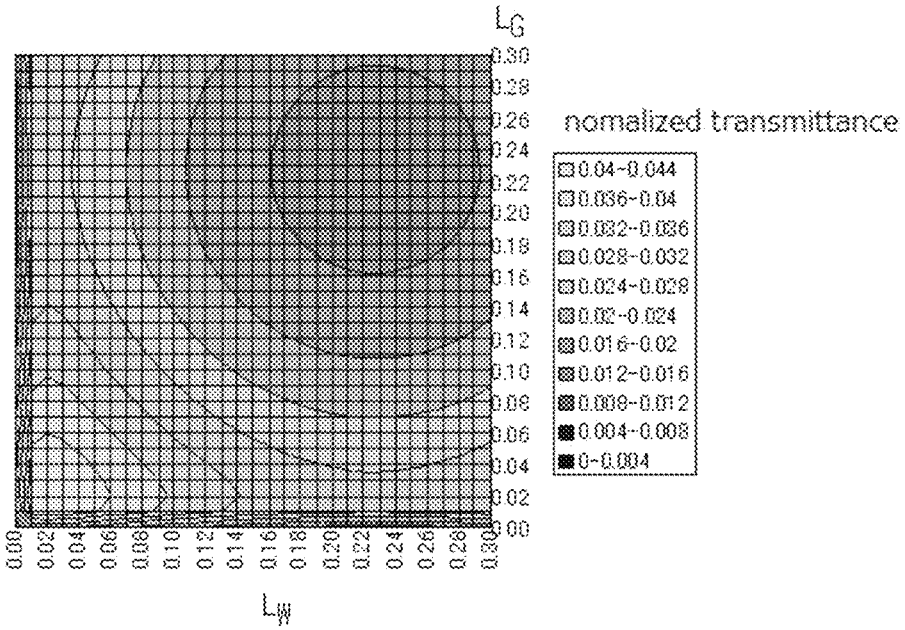
Figures 1, 2, 3:
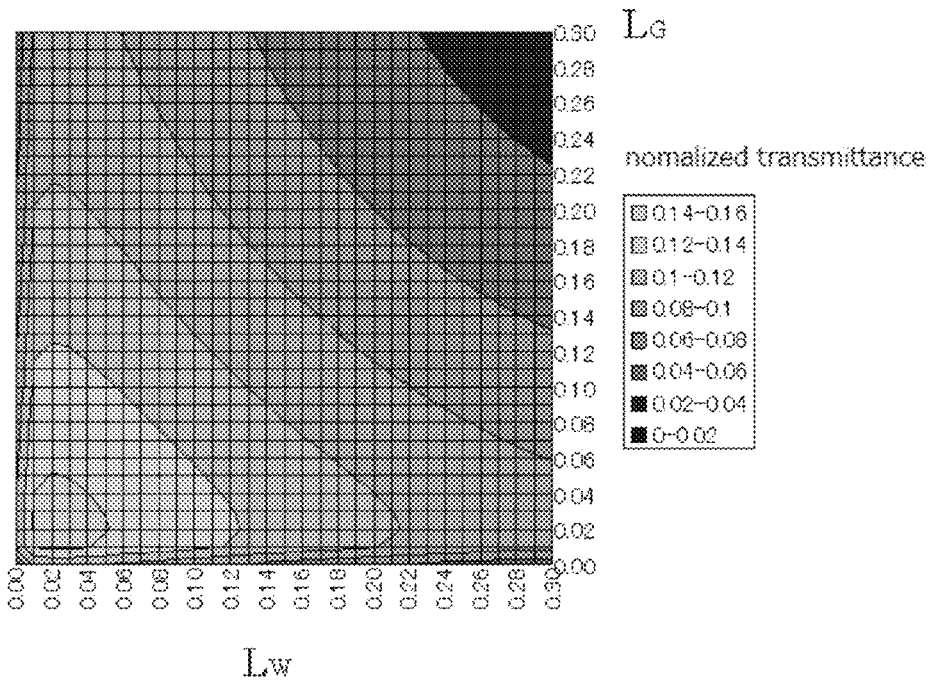
Figure 2:
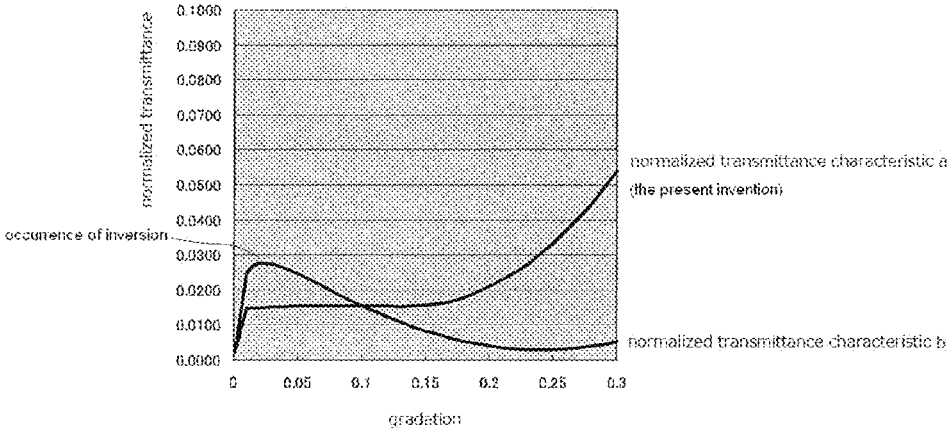
Figures 1, 3:
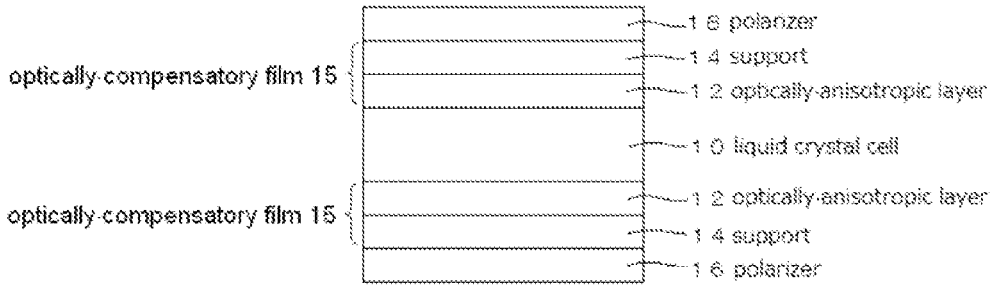

FIGS. 1-1 to 1-3 illustrate exemplary three-dimensional maps as described above. FIG. 1-1 illustrates three-dimensional mapping of the relationship between the contribution rate of each of the grayscale level $L_G$ of the G pixel and the grayscale level $L_W$ of the W pixel to a grayscale level L and the transmittance at downward 30°, for a RGBW TN-mode liquid crystal display in which a "WV-EA film" available from FUJIFILM Corporation is disposed on each of the top and the bottom of a TN-mode liquid crystal cell having a twist angle of 90° and Δnd of 410 nm. The transmittance is normalized assuming that the transmittance at white brightness is 1. The normalized transmittance is obtained for each of the R, G, B, and W pixels. The front normalized transmittance is now described. The front normalized transmittance refers to a transmittance normalized assuming that transmittance of white (approximately maximum transmittance is typically used) is 1 on the basis of the relationship between the voltage and the transmittance at the front. Values of the normalized transmittance are within a range of 0 to 1. The normalized transmittance of substantially 0 (an approximately minimum value is typically used) corresponds to a grayscale level L0

(black), the normalized transmittance of 1 corresponds to a grayscale level L1 (white), and values of the normalized transmittance between 0 and 1 correspond to intermediate grayscale levels. A voltage corresponding to each of the grayscale levels L0 to L1 is applied on the basis of the relationship between the voltage and the transmittance at the front (for example, the relationship illustrated in FIG. 5). For example, a voltage corresponding to the grayscale level L0 (black) is V0, a voltage corresponding to the grayscale level L1 (white) is V1, and voltages corresponding to the intermediate grayscale levels have values between V0 and V1.

The normalized transmittance at downward 30° is now described. A relationship between the voltage and the transmittance at downward 30° is determined at applied voltages V0 to V1 which are determined from the relationship between the voltage and the transmittance at the front. The transmittance is then normalized assuming that the transmittance at downward 30° at V1 (voltage for white) is 1. The relationship is re-expressed with the normalized transmittance into the relationship between the voltage and the normalized transmittance at downward 30°. This relationship is used to determine the normalized transmittance at downward 30° at each grayscale level.

In this way, the normalized transmittance at the front and the normalized transmittance at downward 30° are determined at each grayscale level for each of the R, G, B, and W pixels.

Although the three dimensional maps illustrated in FIGS. 1-1 to 1-3 show a level of transmittance with a shade of black and white, the level of transmittance is actually shown with color variations. For example, if a maximum drive voltage is applied between the electrodes defining each of the G pixel and the W pixel, each grayscale level of $L_G$ and $L_W$ is 0 (black). While a voltage is applied to each of the G pixel and the W pixel such that the contribution rate of $L_W$ is equal to that of $L_G$, the grayscale level L varies from 0 (black) to 1 (white). As a result, the transmittance varies from 0 to 1 along a straight line b. If the variation of transmittance along the straight line b includes a variation of valley-to-peak-to-valley during a variation of the grayscale level L from 0 to 1, such a variation of transmittance is recognized as grayscale inversion.

The map illustrated in FIG. 1-1 reveals that the transmittance varies along the straight line b such that the transmittance increases at a grayscale level L of 0 to 0.03, but decreases at a grayscale level L above 0.03, indicating existence of a variation of valley-to-peak-to-valley. This is shown in a form of a relationship between the grayscale level L and the transmittance at downward 30°. A curved line b in the graph illustrated in FIG. 2 represents this relationship, revealing that grayscale inversion occurs at a grayscale level L of 0.03.

Referring to FIG. 1-1 again, a voltage is applied to drive each of the G pixel and the W pixel such that the grayscale level L varies from 0 to 1 along a path within a range enclosed by straight lines a1, a2, and a3 in the invention. This allows the path of the grayscale level L to avoid the peak of the transmittance at the grayscale level L of 0.03 and the subsequent valley of the transmittance, which cause grayscale inversion, leading to a solution of the problem of grayscale inversion. If the grayscale level L varies within the range enclosed by the straight lines a1, a2, and a3, an exemplary relationship between the grayscale level and transmittance at downward 30° is shown by a curved line a in the graph illustrated in FIG. 2, which reveals that grayscale inversion can be eliminated. It is confirmed that the transmittance in a range of downward 20° to 40° also has characteristics similar to those of the curved line a.

Specifically, in the invention, a voltage $V_{RGB}$ and a voltage $V_W$ satisfying the formulae (ia) and (iia) or (ib) and (iib) below are applied between electrodes defining the G pixel and between electrodes defining the W pixel, respectively, depending on the grayscale level L (where L satisfies $0 \le L \le 1$) in the grayscale where substantially the same voltage $V_{RGB}$ is applied between electrodes defining each of the R, G, and B pixels:

$$\text{for } 0<L\le 0.03,\ T_G=0 \text{ and } T_W=2*L, \tag{ia}$$

$$\text{for } 0.03<L\le 0.3,\ 0.05<T_W/(T_G-0.03)<0.86; \tag{iia}$$

$$\text{for } 0<L\le 0.03,\ T_W=0 \text{ and } T_G=2*L, \tag{ib}$$

$$\text{for } 0.03<L\le 0.3,\ 0.05<T_G/(T_W-0.03)<0.86, \tag{iib}$$

where $T_G$ and $T_W$ each represent the normalized transmittance obtained through normalization of the transmittance of each of the G and W pixels assuming that white brightness in a normal direction to a display surface of a liquid crystal display is 1.

Specifically, at a grayscale level L in the range of more than 0 to 0.03, a voltage is applied to drive one of the G and W pixels such that the transmittance of one pixel corresponds to the transmittance of a black state at the front and the transmittance of the other pixel corresponds to the total transmittance at the front. In other words, a voltage satisfying $T_G=0$ and $T_W=2\times L$ or satisfying $T_W=0$ and $T_G=2\times L$ is applied to drive the pixel. At a grayscale level L in the range of more than 0 to 0.03, the voltage is applied to each of the G and W pixels such that L varies along the straight line a1 in FIG. 1-1.

At a grayscale level L in the range of more than 0.03 to 0.3, a voltage is applied to each of the G and W pixels under the conditions satisfying the following relation:

$$0.05<T_W/(T_G-0.03)<0.86, \text{ or}$$

$$0.05<T_G/(T_W-0.03)<0.86.$$

In other words, a voltage is applied to each of the G and W pixels such that the grayscale level L varies in a range satisfying $T_W>0.05T_G-1.5\times10^{-3}$ and $T_W<0.86T_G-2.55\times10^{-3}$ or in a range satisfying $T_G>0\ 05T_W-1.5\times10^{-3}$ and $T_G<0\ 86T_W-2.55\times10^{-3}$, i.e., within a range enclosed by the straight lines a2 and a3 in FIG. 1-1.

Preferably, the voltage is applied to each of the G and W pixels under the conditions satisfying the following relation:

$$0.05<T_W/(T_G-0.03)<0.5, \text{ or}$$

$$0.05<T_G/(T_W-0.03)<0.5.$$

More preferably, the voltage is applied to each of the G and W pixels under the conditions satisfying the following relation:

$$0.06<T_W/(T_G-0.03)<0.2, \text{ or}$$

$$0.06<T_G/(T_W-0.03)<0.2.$$

If a voltage satisfies the above-described relational expressions, the voltage can be applied to each of the G and W pixels without limitation for displaying the grayscale level L in the range of more than 0.03 to 0.3. Preferably, the voltage is applied to each of the G and W pixels such that $T_W/(T_G-0.03)$ is equal to $T_G/(T_W-0.03)$ at a grayscale level L in the range of more than 0.03 to 0.3. For example, the voltage is preferably applied to each of the G and W pixels such that $T_W/(T_G-0.03)$ or $T_G/(T_W-0.03)$ satisfies the above-described relational expressions, and $T_W/(T_G-0.03)$ and $T_G/(T_W-0.03)$ have the same value at grayscale levels L of 0.05, 0.1, 0.2, and 0.3.

The transmittance does not invert at a grayscale level L exceeding 0.3; hence, the voltage is applied without limitation from the viewpoint of eliminating grayscale inversion at a grayscale level L in the range of more than 0.3 to 1.0. A voltage allowing $T_G=T_W$ is typically applied to drive each of the G and W pixels in light of simplified data processing.

FIG. 3-1 illustrates a schematic sectional view of an exemplary liquid crystal display of the invention. The liquid crystal display illustrated in FIG. 3-1 includes a pair of polarizers 16 of which the absorption axes are orthogonal to each other, a TN-mode liquid crystal cell 10 disposed between the polarizers 16, and optically-compensatory film 15 each provided between each of the pair of polarizers 16 and the liquid crystal cell 10. The optically-compensatory film 15 includes a support 14 and an optically-anisotropic layer 12 including a liquid crystal composition. An undepicted protective film such as a cellulose acylate film is disposed on an outer surface of each polarizer 16.

The liquid crystal cell 10 is a TN-mode liquid crystal cell that is to be twist-aligned at a twist angle of 90°. FIG. 3-2 is a detailed schematic sectional view of an exemplary liquid crystal display of the invention, showing the liquid crystal cell 10 including at least a pair of substrates 31 having electrodes 32 defining pixels on at least one of their opposed surfaces, and a liquid crystal layer 33 that is disposed between the pair of substrates 31 and is to be twist-aligned at a twist angle of 90°. The twist angle of 90° is preferable for achieving high front contrast.

Figures 1, 4:
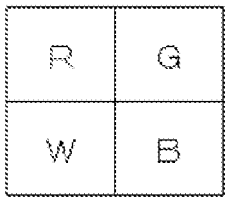

Each pixel group of the liquid crystal cell 10 includes red (R), green (G), blue (B), and white (W) pixels. For example, as illustrated in FIG. 4-1, the liquid crystal cell 10 includes an RGBW color filter disposed on one of the opposed surfaces of the substrates to define the RGBW pixels. An RGBW color filter having any generally proposed configuration, however, can be used without limitation as long as the effect of the invention is not impaired.

Figure 5:
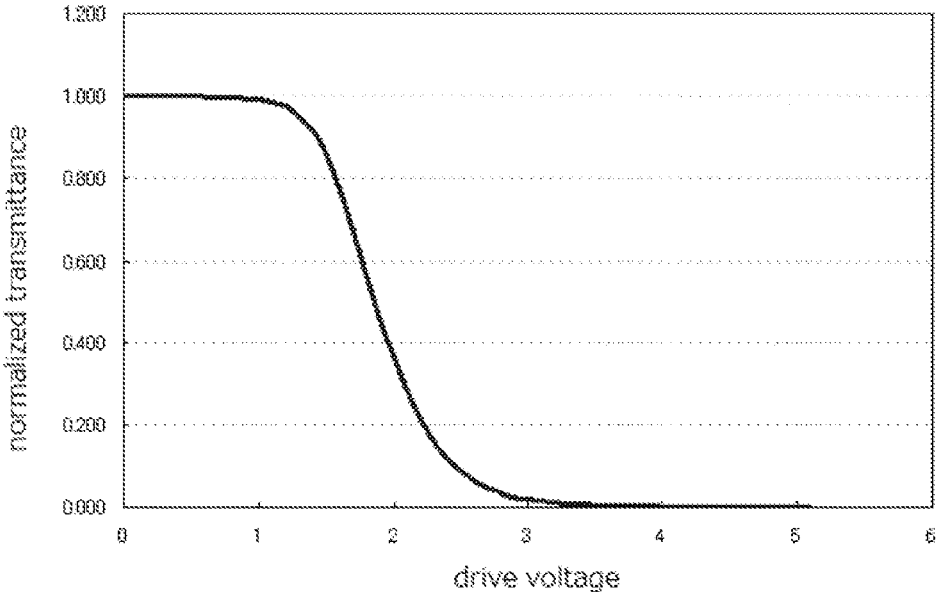
FIG. 5 is a graph showing a relationship between a drive voltage and a grayscale level of a liquid crystal display of Example.
Figures 2, 3:
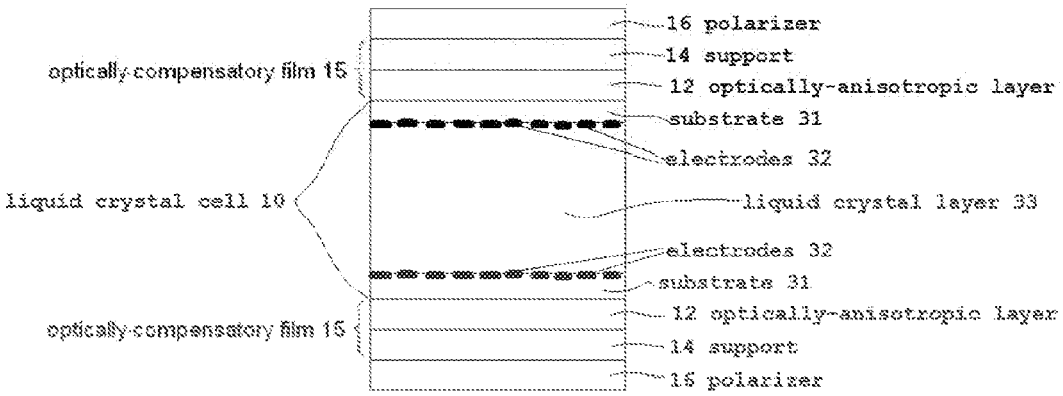
Figure 3:
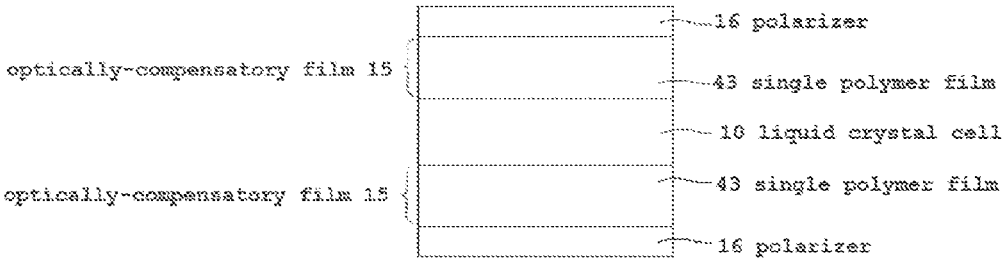
Figures 2, 4:
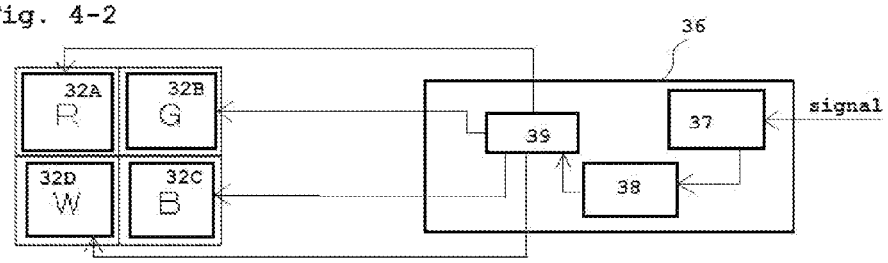

During application of no drive voltage, the nematic liquid crystal layer is twist-aligned, so that the liquid crystal cell 10 is in a white state. When a drive voltage is applied, the twist alignment disappears and the nematic liquid crystal vertically aligns with respect to the substrate, so that the liquid crystal cell 10 is transformed into a black state. For example, the liquid crystal cell 10 is a normally-white-mode liquid crystal cell having drive voltage-versus-normalized transmittance characteristics as illustrated in FIG. 5.

The optically-compensatory film 15, provided between polarizer 16 and the liquid crystal cell 10, is a retardation film that compensates for residual retardation during black display of the liquid crystal cell 10. For example, the optically-anisotropic layer 12 contains discotic liquid crystal fixed in a hybrid alignment state. In this case, the optically-anisotropic layer 12 can compensate for residual retardation caused by tilt alignment of rod-like liquid crystal molecules, which are present in the vicinity of the substrate of the liquid crystal cell 10, with respect to the substrate during black display. The support 14 may or may not contribute to optical compensation. In the embodiment where the support 14 contributes to optical compensation, the support 14 preferably has optical characteristics including retardation in plane, Re(550), of 0 to 30 nm, and a retardation along the thickness direction, Rth (550), of 0 to 200 nm.

In the case where the optically-anisotropic layer containing the discotic liquid crystal fixed in the hybrid alignment state is used for optical compensation of the TN-mode liquid crystal display, the in-plane slow axis of the optically-anisotropic layer is typically disposed at 0° with respect to the transmission axis of an adjacent polarizer. In the invention, the in-plane slow axis of the optically-anisotropic layer may be also disposed at 0° with respect to the transmission axis of an adjacent polarizer.

For example, a "WV-EA film" available from FUJIFILM Corporation can be used as the optically-compensatory film 15. The "WV-EA film" is a laminated film including an optically-anisotropic layer and a support, the optically-anisotropic layer containing discotic liquid crystal fixed in a hybrid alignment state.

The liquid crystal display includes drive control means 36 that controls the liquid crystal display as shown in FIG. 4-2 such that a substantially identical voltage $V_{RGB}$ is applied to the RGB pixels 32A, 32B, 32C, and a voltage $V_W$ is applied to the W pixel 32D in response to external signals for display of the grayscale level L. The drive control means 36 includes a detector 37 that detects information on the grayscale level L from an external signal; an operational unit 38 that determines a voltage applied to each of the G and W pixels under the conditions satisfying the above-described expressions (ia) and (iia) or expressions (ib) and (iib), depending on the detected grayscale level L in a range of 0 to 0.3; and a drive unit 39 that applies the determined voltage to each of the G and W pixels.

The optically-compensatory film 15 disposed between each of the pair of polarizers and the liquid crystal cell in the liquid crystal display of the invention is preferably the above-described laminated film, which includes the optically-anisotropic layer containing the discotic liquid crystal fixed in a hybrid alignment state on the support. In addition, the liquid crystal display preferably includes a retardation film including a single polymer film 43 having specific optical characteristics but not including the optically-anisotropic layer, as shown in FIG. 3-3.

(Retardation Film Including Single Polymer Film)

(Optical Characteristics)

The three-directional refractive indices of the retardation film including a single polymer film are defined such that the refractive index in an in-plane maximum direction is nx, the refractive index in a direction perpendicular to nx is ny, and the refractive index in a thickness direction is nz. In this case, a retardation film satisfying nx>ny>nz is preferable in light of expansion of the view-angle contrast in a horizontal direction of the liquid crystal display as viewed from a viewer.

The retardation in plane, Re (=(nx−ny)×d; where d denotes the thickness), of the retardation film is preferably 1 nm to 200 nm at a wavelength of 590 nm, more preferably 5 nm to 100 nm, and most preferably 15 nm to 80 nm. In particular, an Re of 30 nm to 60 nm is preferable. The retardation along the thickness direction, Rth (={(nx+ny)/2−nz}×d; where d denotes the thickness), of the retardation film is preferably 80 nm to 400 nm at a wavelength of 590 nm, more preferably 75 nm to 200 nm, and most preferably 80 nm to 150 nm. In particular, an Rth of 90 nm to 140 nm is preferable.

(Polymer Material for Film)

Examples of the polymer material used for formation of the retardation film includes, but not limited to, cellulose esters; polycarbonate polymers; polyester polymers such as polyethylene terephthalate and polyethylene naphthalate; acrylic polymers such as polymethyl methacrylate; and styrenic polymers such as polystyrene and acrylonitrile/styrene copolymers (AS resins). In addition, one or more polymers can be selected from polymers including polyolefins such as polyethylene and polypropylene; cyclic polyolefins such as the norbornene; polyolefin-based polymers such as ethylene/propylene copolymers; vinyl chloride polymers; amide polymers such as nylon and aromatic polyamides; imide polymers; sulfone polymers; polyether sulfone polymers; polyether-ether-ketone polymers; polyphenylene sulfide polymers; vinylidene chloride polymers; vinyl alcohol polymers; vinyl butyral polymers; arylate polymers; polyoxymethylene polymers; epoxy polymers; and mixture thereof, and the selected polymer can be used as a main component for producing a polymer film to be used. Alternatively, commercially available general-purpose polymer films can also be used.

Among them, cellulose esters are preferably used. In particular, cellulose acylates having acyl groups such as acetyl groups are preferably used from the viewpoint of polarizing-plate processing suitability, optical expressivity, transparency, mechanical properties, durability, cost, and any other property.

(Cellulose Acylate)

In the case where cellulose acylate is used as a material of the retardation film, the retardation film contains one or two cellulose acylates as the main component. The phrase "cellulose acylate contained as the main component" refers to one cellulose acylate used alone as the material of the film, and refers to one cellulose acylate contained at the highest percentage among a plurality of cellulose acylates used in combination.

Cellulose has free hydroxyl groups at 2-, 3-, and 6-positions per β-(1,4)-bonded glucose unit. Examples of the cellulose acylate preferably include, but not limited to, cellulose acetate, and cellulose acylate having acetyl groups and other acyl groups.

Hydrogen atoms of 2.00 to 2.80 hydroxyl groups on average of the three hydroxyl groups are replaced with acyl groups. In a first preferable embodiment, all the acyl groups are acetyl groups.

In a second preferable embodiment, the cellulose acylate includes cellulose acetate/propionate, cellulose acetate/butyrate, or cellulose acetate/propionate/butyrate, in which hydrogen atoms of 2.00 to 2.80 hydroxyl groups on average of the three hydroxyl groups are replaced with acyl groups, and the hydrogen atoms of 0.50 to 1.50 hydroxyl groups thereof are replaced with propionyl groups and/or butyryl groups.

In the second preferable embodiment, cellulose acetate/propionate is particularly preferably used.

A total degree of substitution of acyl groups is less than 2.00 leads to an increase in non-substituted hydroxyl groups, resulting in an increase in dependence of a film on humidity. As a result, the film is unsuitable for applications requiring humidity resistance, for example, an optical element of a liquid crystal display. In contrast, a total degree of substitution of acyl groups exceeding 2.80 leads to reductions in expressivity of each of Re and Rth. In view of these two points, the total degree of substitution of acyl groups is more preferably 2.20 to 2.70, and most preferably 2.40 to 2.60, in both the first and second preferable embodiments.

If the film is produced by a three-layer co-casting method, the total degree of substitution of acyl groups of cellulose acylate of a core layer is preferably within the above-described range. The total degree of substitution of acyl groups of cellulose acylate in layers (hereinafter, referred to as skin layers) outer than the core layer is preferably more 2.70 to 3.00, and more preferably 2.75 to 2.90.

The degree of substitution of propionyl groups and/or butyryl groups of cellulose acylate in the second preferable embodiment has influence on expressivity of Re and Rth of the film and on the humidity dependence and the elastic modulus thereof. The degree of substitution of propionyl groups and/or butyryl groups is controlled to be 0.5 to 1.5, leading to preferable compatibility between the above-mentioned properties. The degree of substitution of propionyl groups and/or butyryl groups is preferably 0.60 to 1.10, and more preferably 0.80 to 1.00.

In this specification, the total degree of substitution of acyl groups of cellulose acylate can be calculated through measurement of the amount of linked fatty acid per constitutional unit mass of cellulose. The measurement is conducted in accordance with "ASTM D817-91".

The cellulose acylate preferably has a mass-average degree of polymerization of 350 to 800, and more preferably 370 to 600. The cellulose acylate used in the invention preferably has a number average molecular weight of 60000 to 230000, more preferably 70000 to 230000, and most preferably 78000 to 120000.

(Plasticizer)

The retardation film may contain a plasticizer. Plasticizers highly compatible with the main component (for example, cellulose acylate) of the retardation film have satisfactory characteristics suitable for high-quality highly-durable films due to its low bleed out tendency, and low haze formation, low moisture content, and low water vapor permeability of the films.

Examples of the plasticizer usable for the retardation film include, but not limited to, phosphate ester plasticizers, phthalate ester plasticizers, polyhydric alcohol ester plasticizers, polyvalent carboxylate ester plasticizers, glycolate plasticizers, citrate ester plasticizers, fatty acid ester plasticizers, carboxylate ester plasticizers, polyester oligomer plasticizers, sugar ester plasticizers, and copolymer plasticizers of unsaturated ethylene monomers.

Among them, the phosphate ester plasticizers, the phthalate ester compounds, the polyhydric alcohol ester plasticizers; the polyester oligomer plasticizers, the sugar ester plasticizers, and the copolymer plasticizers of unsaturated ethylene monomers are preferably used. More preferably, polyhydric alcohol ester plasticizers, polyester oligomer plasticizers, sugar ester plasticizers, and copolymer plasticizers of unsaturated ethylene monomers are used. Most preferably, sugar ester plasticizers are used.

In particular, polyhydric alcohol ester plasticizers, polyester oligomer plasticizers, sugar ester plasticizers, and copolymer plasticizer of unsaturated ethylene monomers are preferably used since they are highly compatible with cellulose acylate, and are effective for reducing bleed out, haze, and water vapor permeability of the film, and besides they barely decompose and barely cause deterioration and/or deformation of the film due to variations in temperature and/or humidity or due to the lapse of time.

In an embodiment using a biaxial retardation film, it is particularly preferred that the sugar ester plasticizers, the polyester oligomer plasticizers, and the polyhydric alcohol ester plasticizers be used because of their high optical expressivity. In particular, the sugar ester plasticizers are most preferably used since they have a structure similar to that of cellulose acylate, and thus enable production of a film having extremely low haze.

The retardation film of the invention may include one plasticizer or two or more plasticizers being mixed. The use of a mixture of two or more plasticizers leads to an improvement in compatibility compared to use of one plasticizer, resulting in reductions in bleed out and haze. The reason for this is estimated as follows: one of the two plasticizers serves as a compatibilizing agent to improve compatibility of the other plasticizer with the cellulose acylate film.

In the case where a mixture of two or more plasticizers is used, at least one of them is preferably a sugar ester plasticizer or a polyester oligomer plasticizer. More preferably, the plasticizer is a sugar ester plasticizer.

The content of the plasticizer in the retardation film is preferably 0.1 to 50 percent by mass, more preferably 1 to 30 percent by mass, most preferably 5 to 20 percent by mass, and particularly preferably 7 to 15 percent by mass of the main-component polymer (for example, cellulose acylate).

(Polyhydric Alcohol Ester Plasticizer)

The polyhydric alcohol ester plasticizer consists of an ester of a divalent or higher aliphatic polyhydric alcohol and a monocarboxylic acid, and preferably includes an aromatic ring or a cycloalkyl ring in its molecule. The polyhydric alcohol ester plasticizer is preferably a divalent to eicosavalent aliphatic polyhydric alcohol ester plasticizer.

Examples of the polyhydric alcohol preferably used in the invention include, but not limited to, the following polyhydric alcohols.

The examples of the polyhydric alcohol include adonitol, arabitol, ethylene glycol; diethylene glycol, triethylene glycol, tetraethylene glycol, 1,2-propanediol, 1,3-propanediol, dipropylene glycol, tripropylene glycol, 1,2-butanediol, 1,3-butanediol, 1,4-butanediol, dibutylene glycol, 1,2,4-butanetriol, 1,5-pentanediol, 1,6-hexanediol, hexanetriol, galactitol, mannitol, 3-methyl pentane-1,3,5-triol, pinacol, sorbitol, trimethylolpropane, trimethylolethane, and xylitol.

In particular, triethylene glycol, tetraethylene glycol, dipropylene glycol, tripropylene glycol, sorbitol, trimethylolpropane, and xylitol are preferably used.

The polyhydric alcohol ester can be produced with any typical monocarboxylic acid including aliphatic monocarboxylic acids, alicyclic monocarboxylic acids, aromatic monocarboxylic acids, and other monocarboxylic acids without limitation. The alicyclic monocarboxylic acids or the aromatic monocarboxylic acids are preferably used in light of a reduction in moisture permeability and an improvement in retention.

Examples of preferable monocarboxylic acids include, but not limited to, the following monocarboxylic acids.

The aliphatic monocarboxylic acids each preferably include a fatty acid having a straight or side chain having a carbon number of 1 to 32. The carbon number is more preferably 1 to 20, and most preferably 1 to 10. Acetic acid is preferably used to improve compatibility with the cellulose ester. A mixture of acetic acid and another monocarboxylic acid is also preferably used.

Examples of the preferable aliphatic monocarboxylic acids include saturated fatty acids such as acetic acid, propionic acid, butyric acid, valeric acid, caproic acid, enanthic acid, caprylic acid, pelargonic acid, capric acid, 2-ethyl-hexanoic acid, undecylic acid, lauric acid, tridecylic acid, myristic acid, pentadecylic acid, palmitic acid, heptadecylic acid, stearic acid, nonadecanoic acid, arachidic acid, behenic acid, lignoceric acid, cerotic acid, heptacosanoic acid, montanoic acid, melissic acid, and lacceric acid; and unsaturated fatty acid such as undecylenic acid, oleic acid, sorbic acid, linoleic acid, linolenic acid, and arachidonic acid.

Examples of the preferable alicyclic monocarboxylic acids include cyclopentanecarboxylic acid, cyclohexanecarboxylic acid, cyclooctanecarboxylic acid, and derivatives thereof.

Examples of the preferable aromatic monocarboxylic acids include benzoic acid and aromatic monocarboxylic acids such as toluic acid, in each of which 1 to 3 alkyl group or alkoxy group including a methoxy or ethoxy group is incorporated to the benzene ring of benzoic acid, and include an aromatic monocarboxylic acid having two or more benzene rings, such as biphenylcarboxylic acid, naphthalenecarboxylic acid, tetralincarboxylic acid, and derivatives thereof. In particular, benzoic acid is preferably used.

The molecular weight of the polyhydric alcohol ester is preferably, but not limited to, 300 to 1500, and more preferably 350 to 750. The polyhydric alcohol ester in such a range of the molecular weight preferably less volatilizes, and preferably has low moisture permeability and high compatibility with the cellulose ester.

The polyhydric alcohol ester can be produced with one carboxylic acid or a mixture of two or more carboxylic acids. The OH groups in the polyhydric alcohol may be entirely or partially esterified.

(Polyester Oligomer Plasticizer)

The polyester oligomer of the invention is a polycondensate produced from, for example, a mixture of a diol and a dicarboxylic acid.

The number average molecular weight of the polyester oligomer is preferably 300 to 3000.

The number average molecular weight of the polyester oligomer can be measured by a common procedure using gel permeation chromatography (GPC).

For example, the number average molecular weight can be measured under the following conditions: column, TSKgel Super HZM-H, TSKgel Super HZ4000, and TSKgel Super HZ2000 available from TOSOH CORPORATION; temperature of the column, 40° C.; type of eluate, tetrahydrofuran (THF); flow rate, 0.35 ml/min; detector, refractive index (RI) detector; injection volume, 10 μl; sample concentration, 1 g/l; standard sample, polystyrene.

Examples of the dicarboxylic acid include aromatic dicarboxylic acids and aliphatic dicarboxylic acids. These dicarboxylic acids are contained in the polyester oligomer in a form of dicarboxylic acid residues to be esterified with diol residues.

Aromatic Dicarboxylic Acid Residue:

The aromatic dicarboxylic acid residue is contained in a polycondensate produced from a diol and dicarboxylic acids including an aromatic dicarboxylic acid.

The aromatic dicarboxylic acid residue refers to a substructure of the polyester oligomer, which has characteristics of a monomer forming the polyester oligomer. For example, the dicarboxylic acid residue produced from a dicarboxylic acid HOOC—R—COOH is —OC—R—CO—.

The percentage of the aromatic dicarboxylic acid residue in the total dicarboxylic acid residue forming the polyester oligomer used in the invention is preferably, but not limited to, 40 mol % to 100 mol %.

The percentage of the aromatic dicarboxylic acid residue is controlled to be 40 mol % or more, leading to a cellulose acylate film having a high optical anisotropy.

Examples of the aromatic dicarboxylic acid used in the invention include phthalic acid, terephthalic acid, isophthalic acid, 1,5-naphthalenedicarboxylic acid, 1,4-naphthalenedicarboxylic acid, 1,8-naphthalenedicarboxylic acid, 2,8-naphthalenedicarboxylic acid, and 2,6-naphthalenedicarboxylic acid.

The polyester oligomer has the aromatic dicarboxylic acid residue produced from aromatic dicarboxylic acid used for mixing.

The aromatic dicarboxylic acid preferably has an average carbon number of 8.0 to 12.0, more preferably 8.0 to 10.0, and most preferably 8.0. The aromatic dicarboxylic acid in such a range of the average carbon number is preferably highly compatible with cellulose acylate, so that bleed out is less likely to occur during film formation and subsequent hot drawing of the cellulose acylate film. Moreover, the aromatic dicarboxylic acid in the range preferably allows the cellulose acylate film to exhibit anisotropy suitable for the optical retardation film.

In detail, the aromatic dicarboxylic acid preferably includes at least one of phthalic acid, terephthalic acid, and isophthalic acid, more preferably includes at least one of phthalic acid and terephthalic acid, and most preferably includes terephthalic acid. Specifically, terephthalic acid is used as an aromatic dicarboxylic acid for the mixing for formation of the polyester oligomer, so that the aromatic dicarboxylic acid is highly compatible with cellulose acylate, and thus bleed out is less likely to occur during film formation and subsequent hot drawing of the cellulose acylate film. One or more aromatic dicarboxylic acids may be used. If two aromatic dicarboxylic acids are used, phthalic acid and terephthalic acid are preferably used.

Aliphatic Dicarboxylic Acid Residue:

The aliphatic dicarboxylic acid residue is contained in a polycondensate produced from a diol and dicarboxylic acids containing an aliphatic dicarboxylic acid.

In this specification, the aliphatic dicarboxylic acid residue refers to a substructure of the polyester oligomer, which has characteristics of a monomer forming the polyester oligomer. For example, a dicarboxylic acid residue produced from a dicarboxylic acid HOOC—R—COOH is —OC—R—CO—.

Examples of the aliphatic dicarboxylic acid preferably used in the invention include oxalic acid, malonic acid, succinic acid, maleic acid, fumaric acid, glutaric acid, adipic acid, pimelic acid, suberic acid, azelaic acid, sebacic acid, dodecanedicarboxylic acid, and 1,4-cyclohexanedicarboxylic acid.

The polycondensate has aliphatic dicarboxylic acid residues produced from aliphatic dicarboxylic acid used for the mixing.

The aliphatic dicarboxylic acid residue preferably has an average carbon number of, but not limited to, 4.0 to 6.0, more preferably 4.0 to 5.0, and most preferably 4.0 to 4.8. A polycondensate having such a range of the average carbon number is preferred since it is highly compatible with cellulose acylate, so that bleed out is less likely to occur during film formation and subsequent hot drawing of the cellulose acylate film.

In detail, the polycondensate preferably contains a succinic acid residue. If two aliphatic dicarboxylic acids are used, the polycondensate preferably contains a succinic acid residue and an adipic acid residue.

Specifically, one or more aliphatic dicarboxylic acids may be mixed for formation of the polyester oligomer. If two or more aliphatic dicarboxylic acids are used, succinic acid and adipic acid are preferably used.

Use of two aliphatic dicarboxylic acids, i.e., succinic acid and adipic acid enables the average carbon number of the diol residue to be reduced, which is preferable in light of compatibility with cellulose acylate.

At an average carbon number of the aliphatic dicarboxylic acid residue of less than 4.0, the polycondensate is not available since the polyester oligomer cannot be readily synthesized.

Diol:

The diol residue is contained in a polyester oligomer produced from a diol and a dicarboxylic acid.

In this specification, the diol residue refers to a substructure of the polyester oligomer, which has characteristic of a monomer forming the polyester oligomer. For example, a dicarboxylic acid residue produced from a diol HO—R—OH is —O—R—O—.

Examples of the diols forming the polyester oligomer include aromatic diols and aliphatic diols, and preferably include, but not limited to, aliphatic diols.

The diols for the polyester oligomer preferably contains, but not limited to, an aliphatic diol residue having an average carbon number of 2.0 to 3.0. At an average carbon number of the aliphatic diol residue of more than 3.0, the diol is less compatible with cellulose acylate, so that bleed out out is more likely to occur. In addition, this increases heating loss of a compound, and increases the probability of a planar failure that is believed to be caused by contamination during a drying step of the cellulose acylate web. At an average carbon number of the aliphatic diol residue of less than 0.2, the diol is not available since the polyester oligomer cannot be readily synthesized.

Examples of the aliphatic diol include alkyl diols and alicyclic diols, such as ethylene glycol, 1,2-propanediol, 1,3-propanediol, 1,2-butanediol, 1,3-butanediol, 2-methyl-1,3-propanediol, 1,4-butanediol, 1,5-pentanediol, 2,2-dimethyl-1,3-propanediol (neopentyl glycol), 2,2-diethyl-1,3-propanediol (3,3-dimethylolheptane), 2-n-butyl-2-ethyl-1,3-propanediol (3,3-dimethylol heptane), 3-methyl-1,5-pentanediol, 1,6-hexanediol, 2,2,4-trimethyl-1,3-pentanediol, 2-ethyl-1,3-hexanediol, 2-methyl-1,8-octanediol, 1,9-nonanediol, 1,10-decanediol, 1,12-octadecanediol, and diethylene glycol. These are preferably used as a mixture containing ethylene glycol and one or more other aliphatic diols.

A preferred aliphatic diol is at least one of ethylene glycol, 1,2-propanediol, and 1,3-propanediol, and a particularly preferable aliphatic diol is at least one of ethylene glycol and 1,2-propanediol. If two aliphatic diols are used, ethylene glycol and 1,2-propanediol are preferably used.

The polyester oligomer has a diol residue produced from the diol used for the mixing.

Blocking:

Although both terminals of the polyester oligomer may or may not be blocked, the terminals are preferably blocked.

If both terminals of the polyester oligomer are not blocked, the polycondensate is preferably polyester polyol.

If the terminals of the polyester oligomer are blocked, the terminals are preferably blocked through a reaction with a monocarboxylic acid. In that case, both terminals of the polycondensate consist of monocarboxylic acid residues.

Throughout the specification, the monocarboxylic acid residue refers to a substructure of the polyester oligomer, which has characteristics of a monomer forming the polyester oligomer. For example, a monocarboxylic acid residue produced from a monocarboxylic acid R—COOH is R—CO—. Either an aromatic monocarboxylic acid or an aliphatic monocarboxylic acid may be used for the monocarboxylic acid blocking. Examples of the monocarboxylic acid preferably include acetic acid, propionic acid, butanoic acid, and benzoic acid, and derivatives thereof. A mixture of two or more monocarboxylic acids may be used for the blocking.

The polyester oligomer according to the invention is readily synthesized in any usual manner, i.e., by a thermofusion condensation process through a poly esterification reaction or a transesterification reaction of the diol and the dicarboxylic acid, or an interfacial condensation process of chlorides of such acids and glycols. The polyester oligomer according to the invention is described in detail in K. Murai "Theory and Application of Plasticizer", first edition, published by SAIWAI SHOBO Ltd., Mar. 1, 1973. In addition, materials disclosed in Japanese Unexamined Patent Application Publication Nos. 05-155809, 05-155810, 5-197073, 2006-259494, 07-330670, 2006-342227, and 2007-003679 can also be used.

The contents of the aliphatic diol, the dicarboxylic acid ester, and the diol ester as materials contained in the polyester oligomer of the invention in the cellulose acylate film are each preferably less than 1 mass percent, and more preferably less than 0.5 mass percent. Examples of the dicarboxylic acid ester include dimethyl phthalate, dihydroxyethyl phthalate, dimethyl terephthalate, dihydroxyethyl terephthalate, dihydroxyethyl adipate, and di hydroxyethyl succinate. Examples of the diol ester include ethylene diacetate and propylene diacetate.

The hydroxyl value of the polyester oligomer can be measured by, for example, an acetic anhydride process in accordance with Japanese Industrial Standard JIS K3342 (abolished). For a polyester polyol oligomer, the hydroxyl value is preferably 55 to 220, and more preferably 100 to 140.

Examples of the polyester oligomer plasticizer usable in the invention are specifically, but unlimitedly, listed in Table 1.

formula (5)

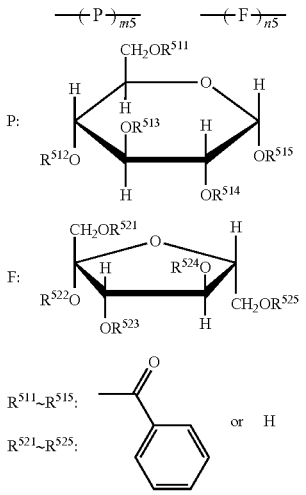

The benzoic acid in the formula may further have substituents, for example, alkyl group, alkenyl group, alkoxyl group, and/or phenyl group. Furthermore, the alkyl group, alkenyl group, and phenyl group may each have any substituent.

TABLE 1

| Compound | Aromatic dicarboxylic acid | Aliphatic diol | Aromatic monocarboxylic acid (Terminal OH blocker) |
|---|---|---|---|
| E-1 | Terephthalic acid | Ethylene glycol | Benzoic acid |
| E-2 | Terephthalic acid | Ethylene glycol | p-Methylbenzoic acid |
| E-3 | Terephthalic acid | 1,2-Propanediol | Benzoic acid |
| E-4 | Terephthalic acid | 1,2-Propanediol | p-Methylbenzoic acid |
| E-5 | 1,4-Naphthalenedicarboxylic acid | Ethylene glycol | Benzoic acid |
| E-6 | 1,4-Naphthalenedicarboxylic acid | Ethylene glycol | p-Methylbenzoic acid |
| E-7 | 1,4-Naphthalenedicarboxylic acid | 1,2-Propanediol | Benzoic acid |
| E-8 | 1,4-Naphthalenedicarboxylic acid | 1,2-Propanediol | p-Methylbenzoic acid |
| E-9 | Phthalic acid | 1,2-Propanediol | Benzoic acid |
| E-10 | Phthalic acid | 1,2-Propanediol | p-Methylbenzoic acid |

(Sugar Ester Plasticizer)

Examples of the preferable sugar ester plasticizer include an ester compound in which at least one hydroxyl group in a compound having 1 to 12 furanose or pyranose structures is esterified.

Examples of the ester compound, in which at least one hydroxyl group in the compound having 1 to 12 furanose or pyranose structures is esterified, include the following compounds:

an esterified compound in which all or part of the hydroxyl groups in a compound (compound (A)) having one furanose or pyranose structure are esterified; and an esterified compound in which all or part of the hydroxyl groups in a compound (compound (B)) are esterified, the compound (B) including 2 to 12 furanose and/or pyranose structures, which are bonded together.

Hereinafter, the esterified compounds of the compound (A) and the esterified compounds of the compound (B) are generally referred to as sugar ester compounds.

The ester compounds are preferably benzoate esters of monosaccharides (α-glucose and β-fructose), or benzoate esters of polysaccharides ($m_5+n_5=2$ to 12) produced through dehydration condensation of any two or more of —$OR^{512}$, —$OR^{515}$, —$OR^{522}$, and —$OR^{525}$ of monosaccharides represented by the following formula (5).

Examples of preferable compounds (A) and preferable compounds (B) include, but not limited to, the following compounds.

Examples of the compound (A) include glucose, galactose, mannose, fructose, xylose, and arabinose.

Examples of the compound (B) include lactose, sucrose, nystos, 1F-fructosyl-nystose, stachyose, maltitol, lactitol, lactulose, cellobiose, maltose, cellotriose, maltotriose, raffinose, and kestose. In addition, the examples of the compound (B) include gentiobiose, gentiotriose, gentiotetraose, xylotriose, and galactosylsucrose.

In particular, the compounds (A) and the compounds (B) each preferably have both the furanose and pyranose structures. For example, sucrose, kestose, nystos, 1F-fructosyl-nystose, and stachyose are preferable. In particular, sucrose is more preferable. In a preferable embodiment, the compound (B) includes a compound in which 2 to 3 furanose and/or pyranose structures are bonded together.

All or part of the hydroxyl groups in each of the compounds (A) and (B) in the invention can be esterified with any typical monocarboxylic acid including aliphatic monocarboxylic acid, alicyclic monocarboxylic acid, aromatic monocarboxylic acid, and other monocarboxylic acids without limitation. One carboxylic acid or a mixture of two or more carboxylic acids may be used.

Examples of the preferable aliphatic monocarboxylic acid include saturated fatty acids such as acetic acid, propionic acid, butyric acid, isobutyric acid, valeric acid, caproic acid, enanthic acid, caprylic acid, pelargonic acid, capric acid, 2-ethylhexanecarboxylic acid, undecylic acid, lauric acid, tridecylic acid, myristic acid, pentadecylic acid, palmitic acid, heptadecylic acid, stearic acid, nonadecanoic acid, arachidic acid, behenic acid, lignoceric acid, cerotic acid, heptacosanoic acid, montanoic acid, melissic acid, and lacceric acid; and unsaturated fatty acid such as undecylenic acid, oleic acid, sorbic acid; linoleic acid, linolenic acid, arachidonic acid, and octenoic acid.

Examples of the preferable alicyclic monocarboxylic acid include cyclopentanecarboxylic acid, cyclohexanecarboxylic acid, cyclooctanecarboxylic acid, and derivatives thereof.

Examples of the preferable aromatic monocarboxylic acid include aromatic monocarboxylic acids such as benzoic acid and toluic acid of which an alkyl or alkoxy group is incorporated to the benzene ring; aromatic monocarboxylic acids having two benzene rings, such as cinnamic acid, benzyl acid, biphenyl carboxylic acid, naphthalene carboxylic acid, tetralin carboxylic acid; and derivatives thereof. More specifically, examples of the preferable aromatic monocarboxylic acid include xylic acid, hemellitic acid, mesitylenic acid, prehnitylic acid, γ-isodurylic acid, durylic acid, mesitoic acid, α-isodurylic acid, cumin acid, α-toluic acid, hydratropic acid, atropic acid, hydrocinnamic acid, salicylic acid, o-anisic acid, m-anisic acid, p-anisic acid, creosote acid, o-homosalicylic acid, m-homosalicylic acid, p-homosalicylic acid, o-pyrocatechuic acid, β-resorcylic acid, vanillic acid, isovanillic acid, veratric acid, o-veratric acid, gallic acid, asaronic acid, mandelic acid, homoanisic acid, homovanillic acid, homoveratric acid, o-homoveratric acid, phthalonic acid, and p-coumaric acid. In particular, benzoic acid is preferably used.

Among the esterified compounds produced through esterification of the compounds (A) and (B), acetylated compounds having acetyl groups incorporated through the esterification, benzoylated compounds having benzoyl groups incorporated therethrough, and compounds having both the acetyl and benzoyl groups incorporated therethrough are preferably used.

In addition to the esterified compounds of the compounds (A) and (B), esterified compounds of oligosaccharides can be used as compounds in each of which 3 to 12 furanose and/or pyranose structures are bonded together.

The oligosaccharides are produced by activity of an enzyme such as amylase for starch, sucrose, or any other saccharides. Examples of the oligosaccharide usable in the invention include malto-oligosaccharide, isomalto-oligosaccharide, fructo-oligosaccharide, galacto-oligosaccharide, and xylo-oligosaccharide.

(Method of Manufacturing Phase Difference Film)

The cellulose acylate film used as the retardation film is preferably formed by a solvent cast process. Although a method of manufacturing the cellulose acylate film is described below as a specific example, the retardation film used in the invention is not limited thereto.

(Solvent Cast Process)

The cellulose acylate film is produced by the solvent cast process in the following manner. That is, cellulose acylate is dissolved in an organic solvent to prepare dope, and the dope is casted onto a surface of a support composed of, for example, metal. The casted dope is then dried and shaped into a film. The film is then peeled off from the surface of the support, and finally stretched as desired.

In the solvent cast process, a solution (dope) including cellulose acylate dissolved in an organic solvent is used for production of a film. The solvent used for preparation of the dope can be selected from organic solvents. The organic solvent preferably includes at least a solvent selected from ethers having 3 to 12 carbon atoms, ketones having 3 to 12 carbon atoms, esters having 3 to 12 carbon atoms, and halogenated hydrocarbon having 1 to 6 carbon atoms.

The ethers, ketones, and esters may each have a cyclic structure. The compounds each having two or more respective functional groups (—O—, —CO—, and —COO—) of ethers, ketones, and esters may be used as organic solvents. The organic solvent may have any other functional group such as alcoholic hydroxyl group. In the case of the organic solvent having two or more functional groups, the number of carbon atom of the organic solvent is preferably within a range of the above-described preferable number of carbon atoms for the solvent having one of the relevant functional groups.

Examples of the ethers having the number of carbon atoms of 3 to 12 include diisopropylether, dimethoxymethane, dimethoxyethane, 1,4-dioxane, 1,3-dioxolane, tetrahydrofuran, anisole; and phenetole.

Examples of the ketones having 3 to 12 carbon atoms include acetone, methyl ethyl ketone, diethyl ketone, diisobutyl ketone, cyclohexanone, and methylcyclohexanone.

Examples of the esters having 3 to 12 carbon atoms include ethyl formate, propyl formate, pentyl formate, methyl acetate, ethyl acetate, and pentyl acetate.

Examples of the organic solvent having two or more functional groups include 2-ethoxyethyl acetate, 2-methoxyethanol, and 2-butoxyethanol.

The number of carbon atoms of the halogenated hydrocarbon is preferably 1 or 2, and more preferably 1. The halogen of the halogenated hydrocarbon is preferably chlorine. The percentage of halogen-substituted hydrogen atoms in the halogenated hydrocarbon is preferably 25 mol % to 75 mol %, more preferably 30 mol % to 70 mol %, further preferably 35 mol % to 65 mol %, and most preferably 40 mol % to 60 mol %. Methylene chloride is typically used as a halogenated hydrocarbon.

A mixture of two or more organic solvents may be used.

The cellulose acylate film is produced from the prepared cellulose acylate solution (dope) by a solvent casting method. Any additive such as the above-described plasticizer is preferably added to the dope.

The dope is casted onto a drum or a belt, and then the solvent in the dope is evaporated to form a film. The concentration of the dope before casting is preferably adjusted such that the solid content thereof is 18% to 35%. The surface of the drum or belt is preferably mirror-finished beforehand. The dope is preferably casted onto the drum or the belt having a surface temperature of 10° C. or less.

In the case where the dope (cellulose acylate solution) is casted on the belt, the cast is dried substantially without air circulation for 10 sec to 90 sec, preferably 15 sec to 90 sec, in the first half of a drying process before peeling. In the case where the dope is casted on the drum, the cast is dried substantially without air circulation for 1 sec to 10 sec, preferably 2 sec to 5 sec, in the first half of the drying process before peeling.

In this specification, "the drying process before peeling" refers to drying in a period from application of dope on a belt or drum to peeling of the dope in a form of a film. The phrase "first half" refers to a step in a period prior to the middle of the total time taken from application to peeling of the dope. The phrase "substantially without air circulation" refers to a condition that a wind velocity of 0.5 m/s or more is not detected (the wind velocity is less than 0.5 m/s) at a distance of 200 mm or less from the surface of the belt or drum.

While the period of the first half of the drying process before peeling is usually about 30 sec to 300 sec for the dope on the belt, the dope is dried without air circulation for 10 sec to 90 sec, preferably 15 sec to 90 sec, in the period. While the period of the first half is usually about 5 sec to 30 sec for the dope on the drum, the dope is dried without air circulation for 1 sec to 10 sec, preferably 2 sec to 5 sec, in the period. The atmospheric temperature is preferably 0° C. to 180° C., and more preferably 40° C. to 150° C. Although the operation of drying without air circulation can be performed at any stage in the first half of the drying process before peeling, the operation is preferably performed immediately after casting. If the period of drying without air circulation is less than 10 sec for the dope on the belt (less than 1 sec for the dope on the drum), the additive is less likely to be uniformly distributed in the film. If the period exceeds 90 sec for the dope on the belt (10 sec for the dope on the drum), the dope is not sufficiently dried before peeling, leading to poor surface morphology of the film.

The dope can be dried through blowing of an inert gas in a period other than the period of drying without air circulation in the drying process before peeling. In this operation, the flowing gas temperature is preferably 0° C. to 180° C., and more preferably 40° C. to 150° C.

The prepared cellulose acylate solution (dope) can be formed into a film through two or more casting cycles of the dope. In this case, the cellulose acylate film is preferably produced by a solvent casting method. The dope is casted on a drum or a belt, and a film is formed through evaporation of the solvent in the dope. The concentration of the dope before casting is preferably adjusted such that the solid content in the dope is within a range of 10% to 40%. The surface of the drum or belt is preferably mirror-finished beforehand.

If a plurality of cellulose acylate solutions are casted into two or more layers, a film may be formed by lamination-casting a plurality of solutions each containing cellulose acylate from a plurality of casting nozzles provided at certain intervals in the advancing direction of a support, the casting nozzles enabling casting of the plurality of cellulose acylate solutions. For example, the film can be formed by methods disclosed in Japanese Unexamined Patent Application Publication Nos. 61-158414, 1-122419, and 11-198285. A cellulose acylate film can also be formed by casting cellulose acylate solutions from two casting nozzles. For example, the film can be formed by methods disclosed in Japanese Examined Patent Application Publication No. 60-27562, and Japanese Unexamined Patent Application Publication Nos. 61-94724, 61-947245, 61-104813, 61-158413, and 6-134933. In addition, the film can be formed by a casting method of a cellulose acylate film disclosed in Japanese Unexamined Patent Application Publication No. 56-162617, in which a stream of a high-viscosity cellulose acylate solution is enveloped by a low-viscosity cellulose acylate solution, and such high and low-viscosity cellulose acylate solutions are concurrently extruded.

In addition, a cellulose acylate film can be produced using two casting nozzles in such a manner that a solution is casted onto a surface of a support from a first casting nozzle to forma first film, and the first film is peeled off from the support, and another solution is then casted from a second casting nozzle onto a contact surface of the first film, the contact surface having been in contact with the surface of the support. A typical method is disclosed in Japanese Examined Patent Application Publication No. 44-20235.

Either the same or different cellulose acylate solutions may be casted. To allow a plurality of cellulose acylate layers to have different functions, a plurality of cellulose acylate solutions corresponding to these functions should be extruded from respective casting nozzles. Furthermore, the cellulose acylate solution of the invention can be casted together with other functional layers such as an adhesion layer, a dye layer, an antistatic layer, an anti-halation layer, an ultraviolet absorption layer, and a polarizing layer, for example.

For a conventional single-layer solution, a cellulose acylate solution having high concentration and high viscosity must be extruded to form a film having a required thickness. In such a case, the cellulose acylate solution is unstable and contains solid components, leading to an asperity failure and/or poor surface smoothness of the film. To solve such a problem, a plurality of cellulose acylate solutions are casted from a plurality of casting nozzles, so that high-viscosity solutions can be concurrently extruded onto a support, resulting in formation of a film having an improved surface smoothness and excellent surface morphology. In addition, use of such a dense cellulose acylate solution enables a reduction in a drying load, leading to an increase in production speed of the film.

In particular, the film preferably has a laminated structure of three or more layers in light of dimensional stability and a reduction in amount of curl associated with variations in atmospheric heat and humidity. In addition, if the above-described high-substitution-degree layers are provided on both sides of the low-substitution-degree layer, the laminated structure is preferable in light of an increase in the degree of freedom in a step of achieving desired optical characteristics.

Only if the film has a laminated structure of three or more layers, a surface layer is referred to as a skin A layer, the surface layer being not in contact with a support during film formation.

In particular, the laminated structure preferably has a three-layer structure of skin B layer/core layer/skin A layer. Although the three-layer structure may have either a configuration of high-substitution-degree layer/low-substitution-degree layer/high-substitution-degree layer or a configuration of low-substitution-degree layer/high-substitution-degree layer/low-substitution-degree layer, the configuration of high-substitution-degree layer/low-substitution-degree layer/high-substitution-degree layer is preferable in light of an improvement in a peel property from a support during liquid film forming and of dimensional stability.

In the case of the three-layer structure, cellulose acylates having the same degree of substitution of acyl groups are preferably contained in surface layers on both sides in light of manufacturing cost, dimensional stability, and a reduction in amount of curl associated with variations in atmospheric heat and humidity.

The cellulose acylate has a width of, for example, 0.5 m to 5 m, and preferably 0.7 m to 3 m. In addition, the cellulose acylate film has a length of 300 m to 30000 m, preferably 500 m to 10000 m, and more preferably 1000 m to 7000 m.

(Stretching)

A cellulose acylate film produced in the above way may be further stretched to adjust retardation in the film, and used as the retardation film. For example, Japanese Unexamined Patent Application Publication Nos. 62-115035, 4-152125, 4-284211, 4-298310, and 11-48271 each discloses a method of actively stretching a film in a width direction, i.e., direction orthogonal to a casting direction during film formation. The film is stretched at normal or elevated temperature. The heating temperature is preferably within ±20° C. of the glass transition temperature of the film. If the film is stretched at a temperature extremely lower than the glass transition temperature, the film is more likely to be broken, which prevents the film from exhibiting desired optical characteristics. If the film is stretched at a temperature extremely higher than the glass transition temperature, molecular orientation, which is caused by the stretching, cannot be thermally fixed since the molecular orientation is relaxed due to heat during the stretching before being fixed, resulting in unsatisfactory optical characteristics.

Furthermore, a sub-zone is provided in a stretching zone, for example, tenter zone, in which the film is nipped and conveyed to be tentered at a maximum tentering rate, and then is normally relaxed. The sub-zone is necessary for reducing axis deviation. In common stretching, after the film is tentered at the maximum tentering rate, the film passes through the remaining tenter zone, i.e., a relaxation zone, within one minute. The film may be stretched in a manner of either uniaxial stretching in a conveying or width direction, or concurrent or sequential biaxial stretching. In each case, the film is preferably stretched more tensionally in the width direction. The film is preferably stretched at a magnification of 1.4 to 2 in the width direction, i.e., in a direction orthogonal to the casting direction during film formation, more preferably at a magnification of 1.4 to 1.6, and most preferably at a magnification of 1.4 to 1.5.

The film may be stretched during a film formation process. Alternatively, after the film is rolled up, the film roll may be fed to stretching. In the former case, the film may be stretched even if it contains a residual solvent, and the film can be preferably stretched at a rate of the residual solvent, i.e., amount of the residual solvent/(amount of the residual solvent+amount of solid component), of 0.05% to 50%. It is particularly preferred the film be stretched at a stretching rate of 5% to 80% at a rate of the residual solvent of 0.05% to 5%.

The retardation film may be a biaxially stretched film, which is produced through biaxial stretching of the cellulose acylate film produced in the above way.

Although biaxial stretching includes a concurrent biaxial stretching process and a sequential biaxial stretching process, the sequential biaxial stretching process is preferably used in light of continuous production, in which dope is casted onto a belt or drum, and a resultant film is peeled off from the belt or drum, and the film is then stretched in a width (or longitudinal) direction, and in turn stretched in a longitudinal (or width) direction.

(Thickness)

The thickness of the retardation film is preferably, but not limited to, 10 μm to 200 μm. Although the retardation film preferably has a smaller thickness in light of thickness reduction of a display, a retardation film less than 10 μm in thickness tends to be less smoothly handled. The thickness is more preferably 10 μm to 80 μm, further preferably 10 μm to 60 μm, and most preferably 10 μm to 50 μm. In particular, the thickness is preferably 10 μm to 40 μm.

In a preferable embodiment of the three-layer structure of skin B layer/core layer/skin A layer as a structure of high-substitution-degree layer/low-substitution-degree layer/high-substitution-degree layer in sequence, an average thickness of the high-substitution-degree layer is preferably 0.1 μm to less than 10 μm, and more preferably 0.5 μm to less than 5 μm. The thickness of the skin layer of less than 0.1 μm degrades a peel property, which may cause streak unevenness, uneven thickness of the film, and unevenness in optical characteristics.

A thickness of the skin layer of more than 10 μm inevitably leads to a small thickness of the core layer since the total thickness is restricted. As a result, the core layer cannot effectively exhibit its optical properties.

(Condenser Sheet)

Figures 1, 6:
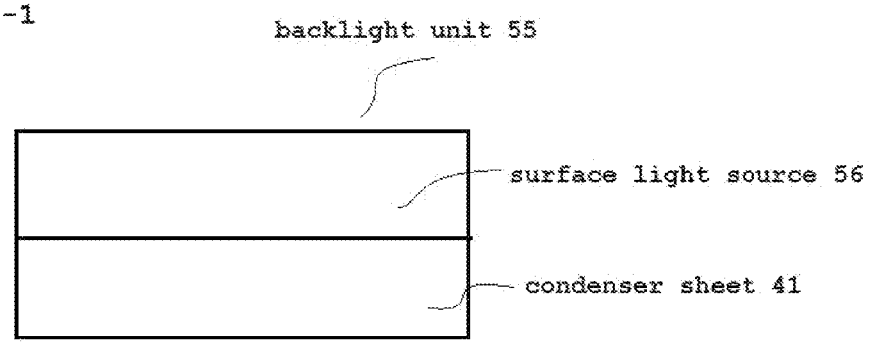
Figures 2, 6:
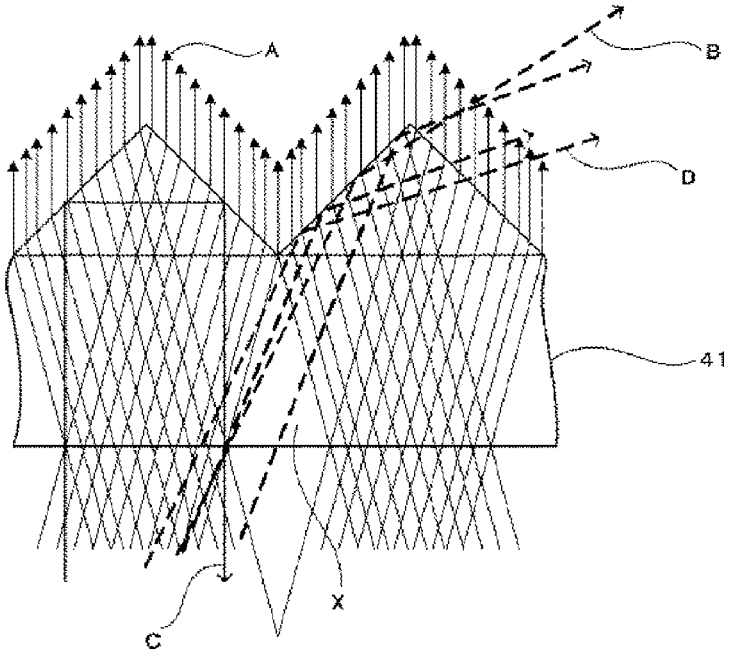
Figure 7:
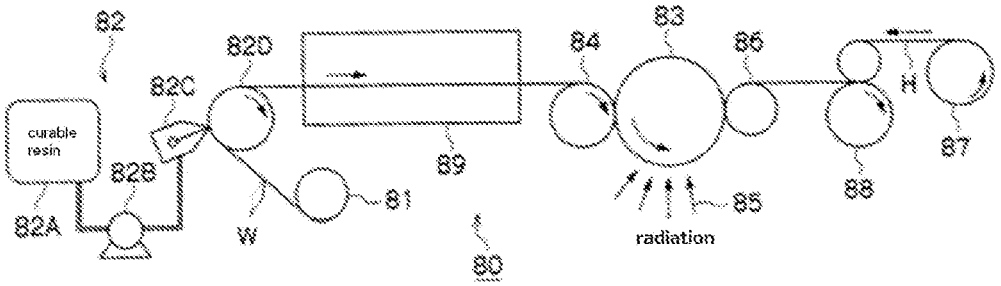
FIG. 7 is a schematic view showing exemplary manufacturing equipment of a prism sheet.

In a particularly preferred embodiment of the invention, the liquid crystal display includes a backlight unit 55 including a surface light source 56 and a condenser sheet 41, as shown in FIG. 6-1, and when the quantity of light emitted from the backlight unit is measured, the average quantity of light at an output angle in a range of 50° to 85° is preferably 12% or less of the quantity of light in a normal direction to a screen of the liquid crystal display, the output angle tilting toward a vertical or horizontal direction on the screen of the liquid crystal display with respect to the normal to the screen of the liquid crystal display as viewed from a viewer.

The condenser sheet, such as a prism sheet and a lens sheet, has irregularity on its surface, and can be produced with various materials and by various methods.

[Material for Condenser Sheet and Method of Manufacturing Condenser Sheet]

Materials for the condenser sheet and a method of manufacturing the condenser sheet are now described.

The condenser sheet according to the invention can be manufactured by any process that can forma prism sheet having a fine irregular pattern without limitation.

In an exemplary available manufacturing process, a resin material is extruded from a die into a sheet, and the sheet-shaped resin material is nipped with a transfer roller (having a surface having a reverse pattern of the irregular pattern on the prism sheet, for example) that rotates at a speed substantially equal to the extrusion speed of the resin material, and a nip roller that is disposed to face the transfer roller and rotates at the same speed, so that the irregular pattern on the surface of the transfer roller is transferred to the resin material.

Thermoplastic resin is used as the resin material for the prism sheet in the method. In detail, such thermoplastic resin include polymethyl methacrylate resin (PMMA), polycarbonate resins, polystyrene resins, modified silicone (MS) resins, acrylonitrile/styrene copolymers (AS resins), polypropylene resins, polyethylene resins, polyethylene terephthalate resins, polyvinyl chloride resins (PVC), cellulose acylate, cellulose triacetate, cellulose acetate propionate, cellulose diacetate, thermoplastic elastomers, and copolymers thereof, and cycloolefin polymers.

[Prism Sheet]

A prism sheet is now described in detail, which is particularly preferably used as the condenser sheet in the invention.

In the liquid crystal display of the invention, when the quantity of light emitted from a backlight unit including a surface light source and a condenser sheet is measured, the average quantity of light at an output angle in the range of 50° to 85° is preferably 12% or less of the quantity of light in a normal direction to a screen of the liquid crystal display, the output angle tilting toward a vertical direction on the screen of the liquid crystal display with respect to the normal to the screen of the liquid crystal display as viewed from a viewer.

FIG. 6-2 is a sectional view illustrating optical paths in a condenser sheet (optical sheet) 41. As illustrated in FIG. 6-2, incident light passes with refraction through the optical sheet 41, during which the light is divided into three components: a component A refracted in a front direction, a component B refracted in a direction away from the front, and component C reflected by a surface of the optical sheet 41. Among the light components, the component A is output in the front direction, i.e., in a viewing direction, and is actually used. The reflective component C is reflected with diffusion by the bottom of the optical sheet 41, and re-enters the prism sheet at a different angle, and is partially converted into the component A that is then output in the front direction. Most of the component C is converted into the component A through repetition of such reflection, leading to an increase in brightness in the front direction of the light output surface.

In contrast, the light component B (hereinafter, referred to as sidelobe light), which passes through the portion X in FIG. 6-2, exits at a large angle to a region outside the effective view-angle region of a display such as the liquid crystal display, and thus does not contribute to an increase in front brightness.

Furthermore, the sidelobe light is incident on the liquid crystal panel at an angle extremely away from the normal direction of the screen, and largely scattered to the front by the liquid crystal molecules in the liquid crystal cell, the color filter, the retardation film, and other components. Such a light component scattered to the front extremely enhances the brightness at black display, causing a reduction in contrast.

The prism sheet preferably used in the liquid crystal display of the invention can reduce the sidelobe light, and prevents an increase in brightness at black display, leading to an increase in contrast.

When the quantity of light emitted from the backlight unit including a reflective polarizing plate, the retardation film, the condenser sheet, and the surface light source is measured, the average quantity of light at an output angle in a range of 50° to 85°, the output angle tilting toward a vertical or horizontal direction on the screen of the liquid crystal display with respect to the normal to the screen as viewed from a viewer, is preferably 12% or less, more preferably 8% or less, and most preferably 4% or less of the quantity of light in the normal direction, from the viewpoint of contrast.

In particular, if the liquid crystal display of the invention includes a TN-mode liquid crystal cell, the screen of the TN-mode liquid crystal cell is commonly disposed such that the long side of a landscape-oriented screen is in a horizontal direction as viewed from a viewer, and an alignment direction of the liquid crystal molecules in the liquid crystal cell is twisted from 45° to 135° so that a phase difference in plane of the TN-mode liquid crystal cell is maximized in a vertical direction; however, the screen of the liquid crystal display cell may be disposed in the opposite direction depending on applications.

In particular, for the liquid crystal display of the invention including the TN-mode liquid crystal cell, in the case where the condenser sheet condenses light in a direction giving a maximum phase difference in plane of the TN-mode liquid crystal cell and little sidelobe light, the liquid crystal display preferably exhibits a notable advantageous effect. Furthermore, the ridgeline of the prism may tilt within a range of 1° to 20° with respect to a black matrix of pixels of the liquid crystal cell in order to prevent moire with the pixels.

The irregular pattern of the section of the prism preferably has a triangular shape, and more preferably an isosceles triangle shape, in which convex portions of the triangles preferably faces the liquid crystal cell.

The triangular shape is characterized in that its vertical angle is preferably 95° to 130°, and more preferably 100° to 120°. The vertical angle of less than 95° is likely to cause an extreme increase in brightness at black display due to the sidelobe light.

In contrast, the vertical angle of more than 130° reduces the light condensing efficiency, which may cause a reduction in brightness in the front direction.

In another preferable embodiment, an optical adjuster provided on the support in addition to the prism can reduce sidelobe light even if the apex angle of the triangular cross-section of the prism is less than 95 degrees.

In another preferable embodiment, a prism sheet includes a plurality of optical adjusters arranged at a predetermined interval in a plane of a surface of the support. The optical adjuster includes a light-reflective type, light-diffusible type, and a type utilizing a refractive index difference. In particular, the light-reflective optical adjuster is preferable.

These optical adjusters are each basically the same as the optical adjuster in each optical sheet disclosed in Japanese Unexamined Patent Application Publication Nos. 2008-003515 and 2008-176197.

(Re and Rth)

In this description, Re(λ) and Rth (λ) are retardation (nm) in plane and retardation (nm) along the thickness direction, respectively, at a wavelength of λ. Re(λ) is measured by applying light having a wavelength of λ nm to a film in the normal direction of the film, using KOBRA 21ADH or WR (by Oji Scientific Instruments). The selection of the measurement wavelength may be conducted according to the manual-exchange of the wavelength-selective-filter or according to the exchange of the measurement value by the program.

When a film to be analyzed is expressed by a monoaxial or biaxial index ellipsoid, Rth(λ) of the film is calculated as follows.

Rth(λ) is calculated by KOBRA 21ADH or WR on the basis of the six Re(λ) values which are measured for incoming light of a wavelength λ nm in six directions which are decided by a 10° step rotation from 0° to 50° with respect to the normal direction of a sample film using an in-plane slow axis, which is decided by KOBRA 21ADH, as an inclination axis (a rotation axis; defined in an arbitrary in-plane direction if the film has no slow axis in plane), a value of hypothetical mean refractive index, and a value entered as a thickness value of the film.

In the above, when the film to be analyzed has a direction in which the retardation value is zero at a certain inclination angle, around the in-plane slow axis from the normal direction as the rotation axis, then the retardation value at the inclination angle larger than the inclination angle to give a zero retardation is changed to negative data, and then the Rth(λ) of the film is calculated by KOBRA 21ADH or WR.

Around the slow axis as the inclination angle (rotation angle) of the film (when the film does not have a slow axis, then its rotation axis may be in any in-plane direction of the film), the retardation values are measured in any desired inclined two directions, and based on the data, and the estimated value of the mean refractive index and the inputted film thickness value, Rth may be calculated according to the formulae (1) and (2):

(1)

$$Re(\theta) = \left[ nx - \frac{ny \times nz}{\sqrt{\left\{ny \sin\left(\sin^{-1}\left(\frac{\sin(-\theta)}{nx}\right)\right)\right\}^2 + \left\{nz \cos\left(\sin^{-1}\left(\frac{\sin(-\theta)}{nx}\right)\right)\right\}^2}} \right] \times \frac{d}{\cos\left\{\sin^{-1}\left(\frac{\sin(-\theta)}{nx}\right)\right\}} \quad (1)$$

Re(θ) represents a retardation value in the direction inclined by an angle θ from the normal direction; nx represents a refractive index in the in-plane slow axis direction; ny represents a refractive index in the in-plane direction perpendicular to nx; and nz represents a refractive index in the direction perpendicular to nx and ny. And "d" is a thickness of the film.

$$Rth=\{(nx+ny)/2-nz\}\times d \quad (2):$$

In the formula, nx represents a refractive index in the in-plane slow axis direction; ny represents a refractive index in the in-plane direction perpendicular to nx; and nz represents a refractive index in the direction perpendicular to nx and ny. And "d" is a thickness of the film.

When the film to be analyzed is not expressed by a monoaxial or biaxial index ellipsoid, or that is, when the film does not have an optical axis, then Rth(λ) of the film may be calculated as follows:

Re(λ) of the film is measured around the slow axis (judged by KOBRA 21ADH or WR) as the in-plane inclination axis (rotation axis), relative to the normal direction of the film from −50 degrees up to +50 degrees at intervals of 10 degrees, in 11 points in all with a light having a wavelength of λ nm applied in the inclined direction; and based on the thus-measured retardation values, the estimated value of the mean refractive index and the inputted film thickness value, Rth(λ) of the film may be calculated by KOBRA 21ADH or WR.

In the above-described measurement, the hypothetical value of mean refractive index is available from values listed in catalogues of various optical films in Polymer Handbook (John Wiley & Sons, Inc.). Those having the mean refractive indices unknown can be measured using an Abbe refract meter. Mean refractive indices of some main optical films are listed below:

cellulose acylate (1.48), cycloolefin polymer (1.52), polycarbonate (1.59), polymethylmethacrylate (1.49) and polystyrene (1.59). KOBRA 21ADH or WR calculates nx, ny and nz, upon enter of the hypothetical values of these mean refractive indices and the film thickness. On the basis of thus-calculated nx, ny and nz, Nz=(nx−nz)/(nx−ny) is further calculated.

In this specification, a refractive index is measured at a wavelength of 550 nm if not otherwise specified.

EXAMPLES

The invention is now described in detail by way of Examples, but the invention should not be limited thereto.

Example 1

1. Preparation of Retardation Films 1 to 3

(1) Retardation Film 1

As described below, a film for a transparent support was prepared, and an alignment film and an optically-anisotropic layer were formed to prepare a retardation film that was to be used as retardation film 1.

(Preparation of Transparent Support)

The following composition was put into a mixing tank, and was heated at 30° C. while being stirred to dissolve the components, thereby a cellulose acetate solution was prepared.

| Composition of cellulose acetate solution (parts by mass) | Inner layer/outer layer |
|---|---|
| Cellulose acetate with degree of acetylation of 60.9% | 100/100 |
| Triphenyl phosphate (plasticizer) | 7.8/7.8 |
| Biphenyl diphenyl phosphate (plasticizer) | 3.9/3.9 |
| Methylene chloride (first solvent) | 293/314 |
| Methanol (second solvent) | 71/76 |
| 1-butanol (third solvent) | 1.5/1.6 |
| Silica particle (AEROSIL R972, available from Nippon Aerosil Co., Ltd.) | 0/0.8 |
| The following retardation enhancer | 1.7/0 |

Retardation enhancer

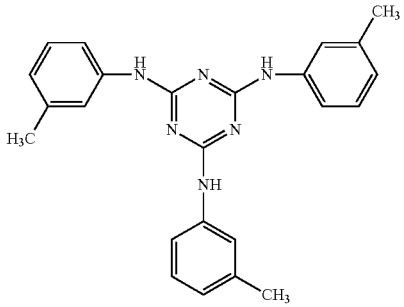

The resultant inner-layer dope and outer-layer dope were casted onto a drum cooled at 0° C. with a three-layer co-casting die. A film containing 70 mass % of residual solvent was peeled off from the drum, and the film was dried at 80° C. while being conveyed at a draw rate of 110% in a conveying direction with both terminals of the film being fixed by a pin tenter. When the amount of residual solvent decreased to 10%, the film was then dried at 110° C. The film was then dried at 140° C. for 30 min, so that a cellulose acetate film having a thickness of 80 μm (first outer layer: 3 μm, inner layer: 74 μm, and second outer layer: 3 μm) was produced with the amount of residual solvent of 0.3 mass %. The resultant cellulose acetate film had retardation in plane Re of −10 nm and retardation Rth along the thickness direction of 90 nm at a wavelength of 550 nm.

The resultant cellulose acetate film was immersed in a 2.0N potassium hydroxide solution (25° C.) for 2 min. The cellulose acetate film was then neutralized with sulfuric acid, washed with purified water, and dried.

(Formation of Alignment Layer)

A liquid having the composition described below was applied on the cellulose acetate film into a volume of 28 mL/m$^2$ using a bar-coater with a #16 wire bar. The coating was then dried by hot air at 60° C. for 60 sec, and in turn dried by hot air at 90° C. for 150 sec. The surface of the coating was subjected to a rubbing process with a rubbing roll rotated at 500 rpm in a direction parallel to the conveying direction, thereby an alignment layer was formed.

| (Composition of liquid for alignment layer) | |
|---|---|
| Modified polyvinyl alcohol described below | 10 parts by mass |
| Water | 370 parts by mass |
| Methanol | 120 parts by mass |
| Glutaraldehyde (cross-linker) | 0.5 parts by mass |

Modified polyvinyl alcohol

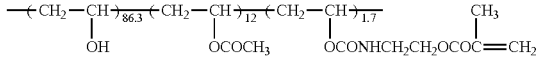

(Formation of Optically-Anisotropic Layer)

A liquid having a composition described below was prepared, and was continuously applied on the surface of the alignment layer on the cellulose acetate film with a #3.2 wire bar. The solvent in the liquid was dried in a step of continuously heating the liquid from ambient temperature to 100° C. The coating was then heated for about 90 sec in a drying zone at 135° C., so that a discotic liquid crystal compound was aligned. The film was then conveyed into a drying zone at 80° C., and while a surface temperature of the film was kept to about 100° C., the discotic liquid crystal compound was irradiated with ultraviolet rays at an illuminance of 600 mW for 10 sec by an ultraviolet irradiator so as to be polymerized through a crosslinking reaction. The film was then cooled to ambient temperature to form the optically-anisotropic layer, thereby an optically compensatory film was produced.

(Composition of liquid for optically-anisotropic layer)

| | |
|---|---|
| Methyl ethyl ketone | 98 parts by mass |
| Discotic liquid crystal compound (1) described below | 41.01 parts by mass |
| Ethylene oxide-modified trimethylol propane triacrylate (V#360, available from Osaka Organic Chemical Industry Ltd) | 4.06 parts by mass |
| Cellulose acetate butyrate (CAB551-0.2, available from Eastman Chemical Company) | 0.34 parts by mass |
| Cellulose acetate butyrate (CAB531-1, available from Eastman Chemical Company) | 0.11 parts by mass |
| Fluoro-aliphatic group-containing polymer 1 described below | 0.13 parts by mass |
| Fluoro-aliphatic group-containing polymer 2 described below | 0.03 parts by mass |
| Photopolymerization initiator (IIRGACURE 907, available from Ciba Geigy) | 1.35 parts by mass |
| Sensitizer (KAYACURE DETX, available from NIPPON KAYAKU CO., LTD.) | 0.45 parts by mass |

Discotic liquid crystal compound (1)

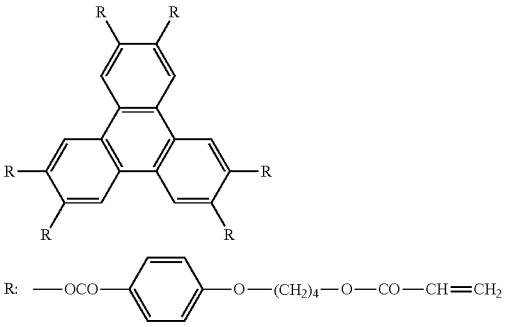

Fluoro-aliphatic group-containing polymer 1 (a/b/c = 20/20/60 percent by mass)

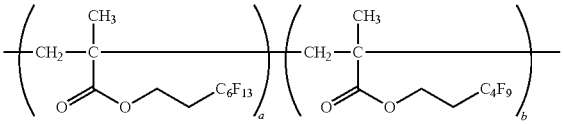

-continued (Composition of liquid for optically-anisotropic layer)

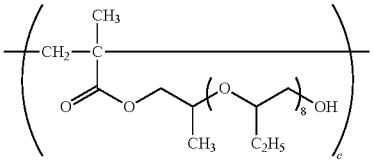

Fluoro-aliphatic group-containing polymer 2 (a/b = 98/2 percent by mass)

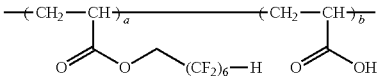

(Measurement of Optical Characteristics)

Each of the resultant optically compensatory films was subjected to measurement of the retardation in plane Re(550) at a wavelength of 550 nm with KOBRA-WR (available from Oji Scientific Instruments). In addition, light having a wavelength of 550 nm was radiated from a direction tilting by ±40° from a normal direction in a plane orthogonal to the slow axis of each optically compensatory film to measure the retardations R[+40°] and R[−40°], and R[−40°]/R[+40°] was calculated.

As a result, Re(550) was 44 nm, and R[−40°]/R[+40°] was 3.0.

(2) Retardation Film 2

As described below, a transparent support was prepared, and an alignment layer and an optically-anisotropic layer were formed to prepare a retardation film that was to be used as retardation film 2.

(Preparation of Transparent Support)

Preparation of Dope

Cellulose acetate solutions were prepared, each containing an oligomer having a composition and a number average molecular weight shown in Table 2 at an amount shown in Table 2.

Composition of cellulose acetate solution

| | |
|---|---|
| Cellulose acetate having average degree of substitution of 2.86 | 100.0 parts by mass |
| Methylene chloride (first solvent) | 475.9 parts by mass |
| Methanol (second solvent) | 113.0 parts by mass |
| Butanol (third solvent) | 5.9 parts by mass |
| Silica particle having mean particle size of 16 nm (AEROSIL R972, available from Nippon Aerosil Co., Ltd.) Oligomer (shown in Table 2) | 0.13 parts by mass |

The prepared solution was casted under a PIT draw condition shown in Table 2 onto a mirror-finished stainless-steel support, a drum 3 m in diameter, through a casting T-die.

When the amount of residual solvent in the web on the support and the surface temperature of the web reached values shown in the above table and Table 2, the web was then stretched in a TD direction at a stretching magnification shown in Table 2. The web was stretched in the TD direction through expanding the web in a direction orthogonal to the conveying direction while both terminal of the web were grasped by a pin tenter. When the amount of residual solvent in the web reached the value shown in Table 2 after stretching, the web was then heat-treated at a surface temperature shown in Table 2. The web was heat-treated through controlling the temperature in the drying zone by drying air. Moreover, the web was heat-treated while the pin tenter was fixed.

In this way, the cellulose acetate film was produced.

TABLE 2

| Formulation | | | | | | | | | | Physical properties | | | | | Process | | | | |
|---|---|---|---|---|---|---|---|---|---|---|---|---|---|---|---|---|---|---|---|
| | | | | | | | | | | | | | | | Stretching | | | Heat treatment | |
| Wavelength dispersion adjuster | | Oligomer composition | | | | | | | | | | | | | Film surface | | | Amount of | Film surface |
| | Additive amount | Dicarboxylic acid unit *1 | | | | Diol unit*2 | | Mw | Additive amount | Re | Rh | Rth(450)/ | ΔHc | Thickness | PIT | temperature | TD | residual | temperature |
| Compound | (parts by mass)) | TPA | PA | AA | SA | EG | PG | *3 | (parts by mass) | (nm) | (nm) | Rth(550) | (J/g) | (μm) | draw | (° C.) | stretching | solvent | (° C.) |
| A | 2.5 | 50 | 0 | 50 | 0 | 50 | 50 | 1000 | 15 | 10 | 100 | 1.1 | 3 | 80 | 104% | 45 | 7% | 50% | 80 |

*1: "TPA" refers to terephthalic acid, "PA" refers to phthalic acid, "AA" refers to adipic acid, and "SA" refers to succinic acid.
*2: "EG" refers to ethanediol, and "PG" refers to 1,3-propandiol.
*3: Mw refers to number average molecular weight.
Compound A is expressed by the following chemical structural formula.

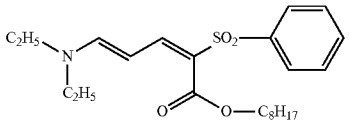

Compound A

The resultant cellulose acetate film was immersed in a 2.0N potassium hydroxide solution (25° C.) for 2 min. The cellulose acetate film was then neutralized with sulfuric acid, washed with purified water, and dried.

(Formation of Alignment Layer)

A liquid having the composition described below was applied on the cellulose acetate film into a volume of 24 mL/m$^2$ using a bar-coater with a #14 wire bar. The coating was then dried by hot air at 100° C. for 120 sec. The surface of the coating was subjected to a rubbing process with a rubbing roll rotated at 500 rpm in a direction at 2° from the conveying direction, thereby an alignment layer was formed.

(Composition of liquid for alignment layer)

| | |
|---|---|
| The following modified polyvinyl alcohol | 10 parts by mass |
| Water | 364 parts by mass |
| Methanol | 114 parts by mass |
| Glutaraldehyde (cross-linker) | 1.0 parts by mass |
| Citrate ester (AS3, from Sankyo Chemical Co.) | 0.35 parts by mass |

Modified polyvinyl alcohol

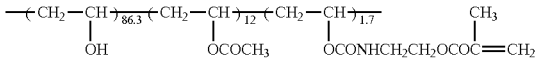

(Formation of Optically-Anisotropic Layer)

A liquid having the following composition was prepared, and was then continuously applied on the surface of the alignment layer on the cellulose acetate film with a #2.4 wire bar. The coating was then heated for about 120 sec in a drying zone at 80° C., so that the discotic liquid crystal compound was aligned. The film was then conveyed into a drying zone at 80° C., and the discotic liquid crystal compound was irradiated with ultraviolet rays at an illuminance of 600 mW for 10 sec with an ultraviolet irradiator so as to be polymerized through a crosslinking reaction. The film was then cooled to ambient temperature to form the optically-anisotropic layer, thereby the retardation film 2 was produced.

(Composition of liquid for optically-anisotropic layer)

| | |
|---|---|
| The following liquid crystal compound (2) | 100.0 parts by mass |
| The following pyridinium salt compound II-1 | 1.0 parts by mass |
| The following triazine ring-containing compound III-1 | 0.2 parts by mass |
| Photopolymerization initiator (IIRGACURE 907, available from Ciba Geigy) | 3.0 parts by mass |
| Sensitizer (KAYACURE DETX, available from NIPPON KAYAKU CO., LTD.) | 1.0 parts by mass |
| Methyl ethyl ketone | 341.8 parts by mass |

Discotic liquid crystal compound (2)

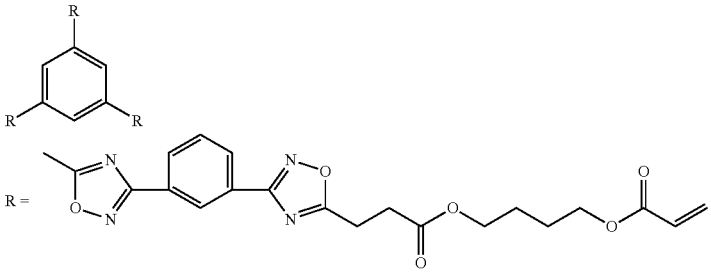

Pyridinium salt compound II-1

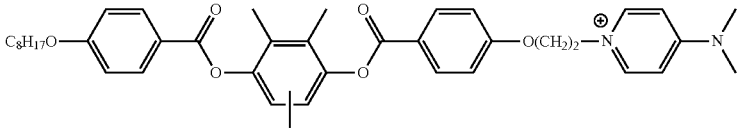

Triazine ring-containing compound

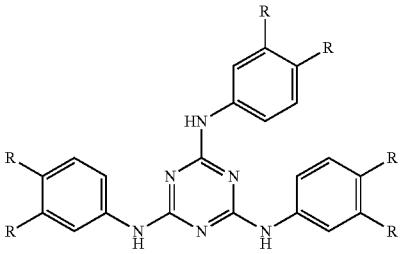

III-1: R = $O(CH_2)_2O(CH_2)_2C_6F_{13}$ (Measurement of Optical Characteristics)

Each of the resultant optically compensatory films was subjected to measurement of the retardation in plane Re(550) at a wavelength of 550 nm with KOBRA-WR (available from Oji Scientific Instruments). Light having a wavelength of 550 nm was radiated from a direction tilting by ±40° from a normal direction in a plane orthogonal to the slow axis of the optically compensatory film to measure the retardations R[+40°] and R[−40°], and R[−40°]/R[+40°] was calculated.

Re(550) was 66 nm, and R[−40°]/R[+40°] was 2.3.

The normalized transmittance characteristics of the retardation film 2 were substantially equivalent to those of the retardation film 1 illustrated in FIG. 1-1.

(3) Retardation Film 3

A triacetyl cellulose (TAC) film "TF80" available from FUJIFILM Corporation was used as an optically compensatory film 3, and retardations were measured. Re(550) was 2 nm, and Rth(550) was 40 nm.

The normalized transmittance characteristics of the retardation film 3 were shown in FIG. 1-2.

2. Production of Polarizing Plate

One of the retardation films 1 to 3 was bonded to one surface of a polarizing film, and the triacetyl cellulose (TAC) film "TF80" available from FUJIFILM Corporation was bonded to the other surface thereof, thereby three types of polarizing plates were produced. Each polarizing plate was bonded to the liquid crystal cell while the retardation film was disposed on a side close to the liquid crystal cell.

In Examples shown in the following Tables, the retardation film 1 or 2 was bonded to a polarizer such that the in-plane slow axis of the retardation film was orthogonal to the absorption axis of the polarizer.

3. Production and Evaluation of Liquid Crystal Display

A TN-mode liquid crystal cell (Δnd=410 nm) having an RGBW color filter having a configuration shown in FIG. 4-1 was prepared, and one of the polarizing plates produced as described above was bonded to each of the top and bottom of the liquid crystal cell, thereby a liquid crystal display having a configuration similar to that illustrated in FIG. 3-1 was produced.

A TN-mode liquid crystal cell (Δnd=410 nm) having an RGB color filter was prepared, and a liquid crystal display was similarly produced as a comparative example.

As shown in Tables 3 to 5, the liquid crystal displays were driven through application of voltages to G and W pixels such that $T_G$ and $T_W$ had values shown in the Tables at each grayscale level L.

During this operation, voltages were applied to R and B pixels such that $T_R$ and $T_B$ were each equal to $T_G$, i.e., the RGB pixels were collectively seen to be achromatic.

The following measurements were conducted assuming that a combination of the RGBW pixels defined one display element. The RGBW pixels were collectively seen to be achromatic.

Transmittance in a front direction and downward grayscale inversion were measured in accordance with the following procedures. The liquid crystal displays were driven in a normally white mode. FIG. 5 illustrates an example relationship between a drive voltage and normalized transmittance.

(Transmittance in Front Direction)

Brightness in a normal direction (front direction) to a screen at white display was measured with BM-5A from TOPCON CORPORATION for each of the resultant liquid crystal displays of the Examples and the comparative examples. Tables 3 to 5 show transmittance of each liquid crystal display, the transmittance being relative transmittance calculated with reference to brightness in the front direction of the liquid crystal display of the comparative example 1. A higher transmittance indicates better characteristics.

(Downward Grayscale Inversion)

Each of the liquid crystal displays of the Examples and the comparative examples was allowed to display grayscale, and an R value defined by $U_{L0.1}/U_{L0.03}$ was obtained assuming that $U_{L0.03}$ was brightness at downward 30° at L=0.03, and $U_{L0.1}$ was brightness at downward 30° at L=0.1.

A larger R value indicates more conspicuous or more invisible grayscale inversion. The R value was classified into the following ranks of numerical value ranges.

Downward grayscale inversion at the rank E is at a practically allowable level.

Rank

A: 1.00≤R.

B: 0.95≤R<1.00

C: 0.90≤R<0.95

D: 0.85≤R<0.90

E: 0.80≤R<0.85

F: R<0.80

Pixel configurations, retardation films, setting of applied voltage control, and observed transmittances in a front direction and downward grayscale inversion are summarized in Tables 3, 4, and 5.

The same measurements and evaluation as described above were conducted under a condition that $T_G$ and $T_W$ in the Tables were exchanged. The same results as those shown in the Tables were obtained.

TABLE 3

| | | | | Examples | | | |
|---|---|---|---|---|---|---|---|
| | | | | 1 | 2 | 3 | 4 |
| Configuration | Pixel configuration | | | RGBW | RGBW | RGBW | RGBW |
| | Retardation film No. | | | 1 | 1 | 1 | 3 |
| | Applied voltage control | | | Performed | Performed | Performed | Performed |
| | Gradation level L | 0 | $T_G$ | 0 | 0 | 0 | 0 |
| | | | $T_W$ | 0 | 0 | 0 | 0 |
| | | 0.01 | $T_G$ | 0 | 0 | 0 | 0 |
| | | | $T_W$ | 0.02 | 0.02 | 0.02 | 0.02 |
| | | 0.02 | $T_G$ | 0 | 0 | 0 | 0 |
| | | | $T_W$ | 0.04 | 0.04 | 0.04 | 0.04 |
| | | 0.03 | $T_G$ | 0 | 0 | 0 | 0 |
| | | | $T_W$ | 0.06 | 0.06 | 0.06 | 0.06 |
| | | 0.05 | $T_G$ | 0.002 | 0.007 | 0.009 | 0.002 |
| | | | $T_W$ | 0.048 | 0.043 | 0.041 | 0.048 |
| | | | $T_G/(T_W-0.03)$ | 0.111 | 0.5 | 0.852 | 0.111 |
| | | 0.1 | $T_G$ | 0.007 | 0.023 | 0.032 | 0.007 |
| | | | $T_W$ | 0.093 | 0.077 | 0.068 | 0.093 |
| | | | $T_G/(T_W-0.03)$ | 0.111 | 0.5 | 0.852 | 0.111 |
| | | 0.2 | $T_G$ | 0.017 | 0.057 | 0.078 | 0.017 |
| | | | $T_W$ | 0.183 | 0.143 | 0.122 | 0.183 |
| | | | $T_G/(T_W-0.03)$ | 0.111 | 0.5 | 0.852 | 0.111 |
| | | 0.3 | $T_G$ | 0.027 | 0.09 | 0.124 | 0.027 |
| | | | $T_W$ | 0.273 | 0.21 | 0.176 | 0.273 |
| | | | $T_G/(T_W-0.03)$ | 0.111 | 0.5 | 0.852 | 0.111 |
| | Twist angle of liquid crystal | | | 90° | 90° | 90° | 90° |

TABLE 3-continued

| | | Examples | | | |
|---|---|---|---|---|---|
| | | 1 | 2 | 3 | 4 |
| Evaluation | Transmittance in front direction | 1.5 | 1.5 | 1.5 | 1.5 |
| | Downward grayscale inversion R value | B | C | D | E |

TABLE 4

| | | | | Comparative examples | | | |
|---|---|---|---|---|---|---|---|
| | | | | 1 | 2 | 3 | 4 |
| Configuration | Pixel configuration | | | RGB | RGBW | RGB | RGBW |
| | Retardation film No. | | | 3 | 3 | 1 | 1 |
| | Applied voltage control | | | not | not | not | not |
| | Gradation level L | 0 | TG | 0 | 0 | 0 | 0 |
| | | | TW | 0 | 0 | 0 | 0 |
| | | 0.01 | TG | 0.01 | 0.01 | 0.01 | 0.01 |
| | | | TW | 0.01 | 0.01 | 0.01 | 0.01 |
| | | 0.02 | TG | 0.02 | 0.02 | 0.02 | 0.02 |
| | | | TW | 0.02 | 0.02 | 0.02 | 0.02 |
| | | 0.03 | TG | 0.03 | 0.03 | 0.03 | 0.03 |
| | | | TW | 0.03 | 0.03 | 0.03 | 0.03 |
| | | 0.05 | TG | 0.03 | 0.03 | 0.03 | 0.03 |
| | | | TW | 0.03 | 0.03 | 0.03 | 0.03 |
| | | | TG/(TW-0.03) | ∞ | ∞ | ∞ | ∞ |
| | | 0.1 | TG | 0.03 | 0.03 | 0.03 | 0.03 |
| | | | TW | 0.03 | 0.03 | 0.03 | 0.03 |
| | | | TG/(TW-0.03) | ∞ | ∞ | ∞ | ∞ |
| | | 0.2 | TG | 0.03 | 0.03 | 0.03 | 0.03 |
| | | | TW | 0.03 | 0.03 | 0.03 | 0.03 |
| | | | TG/(TW-0.03) | ∞ | ∞ | ∞ | ∞ |
| | | 0.3 | TG | 0.03 | 0.03 | 0.03 | 0.03 |
| | | | TW | 0.03 | 0.03 | 0.03 | 0.03 |
| | | | TG/(TW-0.03) | ∞ | ∞ | ∞ | ∞ |
| | Twist angle of liquid crystal | | | 90° | 90° | 90° | 90° |
| Evaluation | Transmittance in front direction | | | 1 | 1.5 | 1 | 1.5 |
| | Downward grayscale inversion R value | | | F | F | E | E |

TABLE 5

| | | | | Examples | | | | | | | | |
|---|---|---|---|---|---|---|---|---|---|---|---|---|
| | | | | 5 | 6 | 7 | 8 | 9 | 10 | 11 | 12 | 13 |
| Configuration | Pixel configuration | | | RGBW | RGBW | RGBW | RGBW | RGBW | RGBW | RGBW | RGBW | RGBW |
| | Retardation film No. | | | 2 | 2 | 2 | 1 | 1 | 1 | 2 | 2 | 2 |
| | Applied voltage control | | | Performed | Performed | Performed | Performed | Performed | Performed | Performed | Performed | Performed |
| | Gradation level L | 0 | $T_G$ | 0 | 0 | 0 | 0 | 0 | 0 | 0 | 0 | 0 |
| | | | $T_W$ | 0 | 0 | 0 | 0 | 0 | 0 | 0 | 0 | 0 |
| | | 0.01 | $T_G$ | 0 | 0 | 0 | 0 | 0 | 0 | 0 | 0 | 0 |
| | | | $T_W$ | 0.02 | 0.02 | 0.02 | 0.02 | 0.02 | 0.02 | 0.02 | 0.02 | 0.02 |
| | | 0.02 | $T_G$ | 0 | 0 | 0 | 0 | 0 | 0 | 0 | 0 | 0 |
| | | | $T_W$ | 0.04 | 0.04 | 0.04 | 0.04 | 0.04 | 0.04 | 0.04 | 0.04 | 0.04 |
| | | 0.03 | $T_G$ | 0 | 0 | 0 | 0 | 0 | 0 | 0 | 0 | 0 |
| | | | $T_W$ | 0.06 | 0.06 | 0.06 | 0.06 | 0.06 | 0.06 | 0.06 | 0.06 | 0.06 |
| | | 0.05 | $T_G$ | 0.002 | 0.007 | 0.009 | 0.002 | 0.002 | 0.002 | 0.002 | 0.002 | 0.002 |
| | | | $T_W$ | 0.048 | 0.043 | 0.041 | 0.048 | 0.048 | 0.048 | 0.048 | 0.048 | 0.048 |
| | | | $T_G/(T_W-0.03)$ | 0.111 | 0.5 | 0.852 | 0.111 | 0.111 | 0.111 | 0.111 | 0.111 | 0.111 |
| | | 0.1 | $T_G$ | 0.007 | 0.023 | 0.032 | 0.007 | 0.007 | 0.007 | 0.007 | 0.007 | 0.007 |
| | | | $T_W$ | 0.093 | 0.077 | 0.068 | 0.093 | 0.093 | 0.093 | 0.093 | 0.093 | 0.093 |
| | | | $T_G/(T_W-0.03)$ | 0.111 | 0.5 | 0.852 | 0.111 | 0.111 | 0.111 | 0.111 | 0.111 | 0.111 |
| | | 0.2 | $T_G$ | 0.017 | 0.057 | 0.078 | 0.017 | 0.017 | 0.017 | 0.017 | 0.017 | 0.017 |
| | | | $T_W$ | 0.183 | 0.143 | 0.122 | 0.183 | 0.183 | 0.183 | 0.183 | 0.183 | 0.183 |
| | | | $T_G/(T_W-0.03)$ | 0.111 | 0.5 | 0.852 | 0.111 | 0.111 | 0.111 | 0.111 | 0.111 | 0.111 |
| | | 0.3 | $T_G$ | 0.027 | 0.09 | 0.124 | 0.027 | 0.027 | 0.027 | 0.027 | 0.027 | 0.027 |
| | | | $T_W$ | 0.273 | 0.21 | 0.176 | 0.273 | 0.273 | 0.273 | 0.273 | 0.273 | 0.273 |
| | | | $T_G/(T_W-0.03)$ | 0.111 | 0.5 | 0.852 | 0.111 | 0.111 | 0.111 | 0.111 | 0.111 | 0.111 |

TABLE 5-continued

| | | Examples | | | | | | | | |
|---|---|---|---|---|---|---|---|---|---|---|
| | | 5 | 6 | 7 | 8 | 9 | 10 | 11 | 12 | 13 |
| | Twist angle of liquid crystal | 90° | 90° | 90° | 85° | 80° | 75° | 85° | 80° | 75° |
| Eval- | Transmittance in front direction | 1.55 | 1.6 | 1.55 | 1.55 | 1.6 | 1.55 | 1.55 | 1.6 | 1.55 |
| uation | Downward grayscale inversion R value | A | B | C | B | B | B | A | A | A |

Example II

Production of Retardation Film 4

(Preparation of Cellulose Acylate Solution 1C)

Cellulose acylate and a composition described below were put into a mixing tank, and were stirred to dissolve the components, thereby a cellulose acylate solution 1C was prepared.

| Composition of cellulose acylate solution 1C | |
|---|---|
| Cellulose acylate CE-1 | 100 parts by mass |
| Polyester oligomer A-1 | 10 parts by mass |
| Methylene chloride (first solvent) | 403.0 parts by mass |
| Methanol (second solvent) | 60.2 parts by mass |

(Preparation of Cellulose Acylate Solution 1S)

Cellulose acylate and a composition described below were put into a mixing tank, and were stirred to dissolve the components, thereby a cellulose acylate solution 1S was prepared.

| Composition of cellulose acylate solution 1S | |
|---|---|
| Cellulose acylate CE-2 | 100 parts by mass |
| Polyester oligomer A-1 | 5 parts by mass |
| Methylene chloride (first solvent) | 403.0 parts by mass |
| Methanol (second solvent) | 60.2 parts by mass |

(Preparation of Matting Agent Solution 1)

A composition described below was put into a mixing tank, and was stirred to dissolve the components, thereby a matting agent solution 1 was prepared.

| Composition of matting agent solution 1 | |
|---|---|
| Silica particle having mean particle size of 16 nm (AEROSIL R972, available from Nippon Aerosil Co., Ltd.) | 2.0 parts by mass |
| Methylene chloride (first solvent) | 72.4 parts by mass |
| Methanol (second solvent) | 10.8 parts by mass |
| Cellulose acylate solution 1S | 10.3 parts by mass |

CE-1: degree of substitution of acetyl groups, 2.42; total degree of substitution, 2.42
CE-2: degree of substitution of acetyl groups, 2.81; total degree of substitution, 2.81

CE-1: degree of substitution of acetyl groups, 2.42; total degree of substitution, 2.42

CE-2: degree of substitution of acetyl groups, 2.81; total degree of substitution, 2.81

TABLE 6

| Polyester oligomer A-1 | | | | |
|---|---|---|---|---|
| Dicarboxylic acid residue | Diol residue | | | Number average |
| Terephthalic acid | Ethylene glycol | Propylene glycol | Both terminals | molecular weight |
| 100 mol % | 50 mol % | 50 mol % | Acetic acid blocking | 900 |

In the casting process, outer layer (belt layer) dope, core layer dope, and outer layer (air layer) dope were casted in this order onto a belt by three-layer co-casting using a metal belt caster, and the cast was dried and then peeled off from the belt by a peeling drum.

The core layer dope was a mixture of 100 parts by mass of cellulose acylate solution 1C and 1.35 parts by mass of matting agent solution 1. The outer layer dope was a mixture of 100 parts by mass of cellulose acylate solution 1S and 1.35 parts by mass of matting agent solution 1.

The film containing less than 1% residual solvent was MD-stretched at a stretching magnification of 1.05 through fixed-terminal uniaxial stretching at an ambient temperature of 185° C., and then TD-stretched at a stretching magnification of 1.30 in a tenter zone at an ambient temperature of 185° C.

The film was then unclipped and dried, so that the retardation film 1 having a width of 2000 mm was produced. The resultant retardation film 4 had a residual solvent content of 0.1% and thickness of 50 μm.

The retardation in plane Re, the retardation along the thickness direction Rth, and total haze of the resultant retardation film were measured according to the procedures described in this application. After the film was left for a sufficient time in an atmosphere of 25° C. and 60% RH, such measurements were conducted in the same atmosphere.

Results of the measurements are shown in Table 7.

FIG. 1-3 illustrates normalized transmittance characteristics of the retardation film 4.

(Production of Polarizing Plate 1)

A polarizing film was produced through adsorption of iodine onto a stretched polyvinyl alcohol film.

The resultant retardation film 4 was bonded to one side of the polarizing film with a polyvinyl alcohol adhesive, and a protective TAC film was bonded to the other side of the polarizing film. In this operation, the retardation film 4 and the polarizing film were bonded to each other such that the longitudinal direction of the polyvinyl alcohol film corresponds to the longitudinal direction of the retardation film 4, and were disposed such that the slow axis of the retardation film 4 was parallel to the transmission axis of the polarizing film.

In this way, the polarizing plate 1 was produced.

TABLE 7

| | Thickness (μm) | Re (nm) | Rth (nm) | Total haze (%) |
|---|---|---|---|---|
| Retardation film 4 | 50 | 36 | 122 | 0.20 |

Furthermore, the following prism sheet for a backlight was produced.

(Production of Condenser Sheet for Example II)

A prism sheet was produced in the following way.

[Preparation of Coating Liquid for Prism Layer]

A coating liquid for a prism layer was prepared according to the following recipe.

The following composition was put into a mixing tank, and was heated at 50° C. while being stirred to dissolve the components, thereby a coating liquid was prepared. The refractive index of the cured prism layer was 1.59. The refractive index of the prism layer was measured for a flat coating formed of the same liquid by a prism coupler refractometer (SPA4000, from Sairon Technology Inc.).

| | |
|---|---|
| Ebecryl 3700 (available from Daicel UBC Co.) | 2.55 parts by mass |
| NK ester BPE-200 (available from Shin-Nakamura Chemical Co., Ltd) | 0.85 parts by mass |
| Alonix M-110 (available from Toagosei Co., Ltd.) | 0.85 parts by mass |
| NEW FRONTIER BR-31 (available from Dai-ichi Kogyo Seiyaku Co., Ltd.) | 4.25 parts by mass |
| Methyl ethyl ketone | 2.89 parts by mass |
| Lucirin TPO-L (available from BASF Ltd.) | 0.17 parts by mass |

[Production of Prism Sheet A]

The coating liquid for a prism layer prepared as described above was applied onto a first surface of a 25 μm thick transparent PET support, of which both sides were subjected to pre-adhesion treatment, such that the dry mass was 14 g/m$^2$, and the prism layer was then dried for 1 min at 80° C. The prism layer was then pressed against a metal mold (die), on which the prism shapes were carved in a stripe pattern at a pitch (bottom length) of 50 μm, each prism shape having a section of an isosceles triangle with a vertical angle of 90°. The prism layer in such a pressed state was exposed to light with a high-pressure mercury vapor lamp to cure the prism layer. The resultant film was separated from the die, thereby a prism sheet A (a support having an irregular portion thereon) was produced.

(Preparation of Coating Liquid for White Reflective Layer)

A coating liquid for a white reflective layer was prepared according to the following recipe.

[Composition of White Pigment-Dispersed Mother Liquid]

Polyvinyl butyral (S-LEC B BL-SH, available from SEKISUI

| | |
|---|---|
| Polyvinyl butyral (S-LEC B BL-SH, available from SEKISUI CHEMICAL CO., LTD.) | 2.7 parts by mass |
| Rutile-type titanium oxide (JR805, available from TAYCA CORPORATION, mass-average particle diameter of 0.29 μm) | 35.0 parts by mass |
| Dispersing aid (SOLSPERSE 20000, available from Avecia Inc.) | 0.35 parts by mass |
| N-propyl alcohol | 62.0 parts by mass |

The above composition was dispersed by an Eiger motor mill M50 using zirconia beads, thereby a white pigment-dispersed mother liquid was prepared.

[Composition of Coating Liquid for White Reflective Layer]

| | |
|---|---|
| White pigment-dispersed mother liquid prepared as described above | 1200 parts by mass |
| Wax compounds | |
| Stearamide (NEUTRON-2, available from NIPPON FINE CHEMICAL CO., LTD.) | 5.7 parts by mass |
| Behenamide (DIAMID BM, available from Nippon Kasei Chemical Company Limited) | 5.7 parts by mass |
| Lauramide (DIAMID Y, available from Nippon Kasei Chemical Company Limited) | 5.7 parts by mass |
| Palmitamide (DIAMID KP, available from Nippon Kasei Chemical Company Limited) | 5.7 parts by mass |
| Erucamide (DIAMID L-200, available from Nippon Kasei Chemical Company Limited) | 5.7 parts by mass |
| Oleamide (DIAMID O-200, available from Nippon Kasei Chemical Company Limited) | 5.7 parts by mass |
| Rodin (KE-311, available from ARAKAWA CHEMICAL INDUSTRIES, LTD., Components: resin acid 80% to 97%; Resin acid components: abietic acid 30% to 40%, neoabietic acid 10% to 20%, dihydroabietic acid 14%, tetrahydroabietic acid 14%) | 80.0 parts by mass |
| Surfactant (MEGAFAC F-780F, solid content 30%, available from DIC Corporation) | 16.0 parts by mass |
| N-propyl alcohol | 1600 parts by mass |
| Methyl ethyl ketone | 580 parts by mass |

(Production of White Reflective Sheet)

The coating liquid for a white reflective layer prepared as described above was applied onto a 25 μm thick PET support such that dried film thickness was 2 μm. The white reflective layer was then dried for 2 min at 100° C., thereby a white reflective sheet was produced.

(Preparation of Coating Liquid for Positive Photosensitive Layer)

A coating liquid for a positive photosensitive layer was prepared according to the following recipe.

| | |
|---|---|
| Phenol novolak resin (PR-50716, available from Sumitomo Durez Co., Ltd., melting point: 76° C.) | 2.5 parts by mass |
| Phenol novolak resin (PR-51600B, available from Sumitomo Durez Co., Ltd., melting point: 55° C.) | 3.5 parts by mass |
| 1,2-Naphthoquinone-2-diazido-4-cumylphenol sulfonate phenol ester | 2.0 parts by mass |
| Methyl ethyl ketone | 40 parts by mass |
| Propyleneglycol monomethyl ether acetate | 20 parts by mass |
| Surfactant (MEGAFAC F-176PF, available from DIC Corporation) | 0.1 parts by mass |

(Preparation of Alkaline Developer)

An alkaline developer having a composition described below was prepared.

| | |
|---|---|
| Sodium carbonate | 59 parts by mass |
| Sodium bicarbonate | 32 parts by mass |
| Water | 720 parts by mass |
| Ethyleneglycol monobutyl ether | 1 parts by mass |

(Production of Light-Condensing Optical Sheet: Prism Sheet B)

Figure 8A:
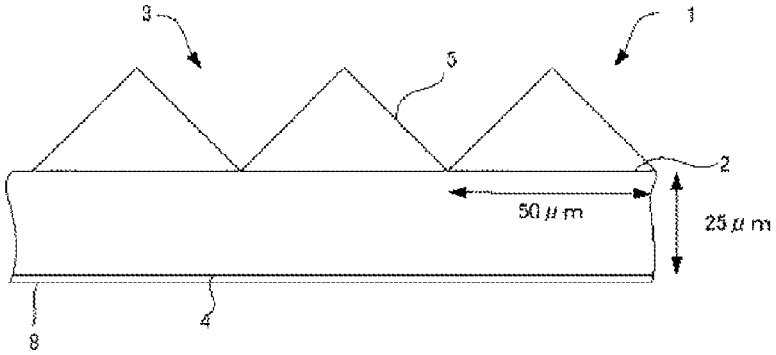
FIG. 8A is a schematic sectional view of a prism sheet A having a positive photosensitive layer 8 on a second surface 4 of a support 2.

As illustrated in FIG. 8A, the coating liquid for a positive photosensitive layer prepared as described above was applied on a second flat surface 4 of the prism sheet A (the support 2 having an irregular portion 5 thereon) produced as described above such that dried film thickness was 0.5 μm. The applied positive photosensitive layer was then dried for 2 min at 100° C., thereby a positive photosensitive layer 8 was formed on the second surface 4 of the support 2.

Figure 8B:
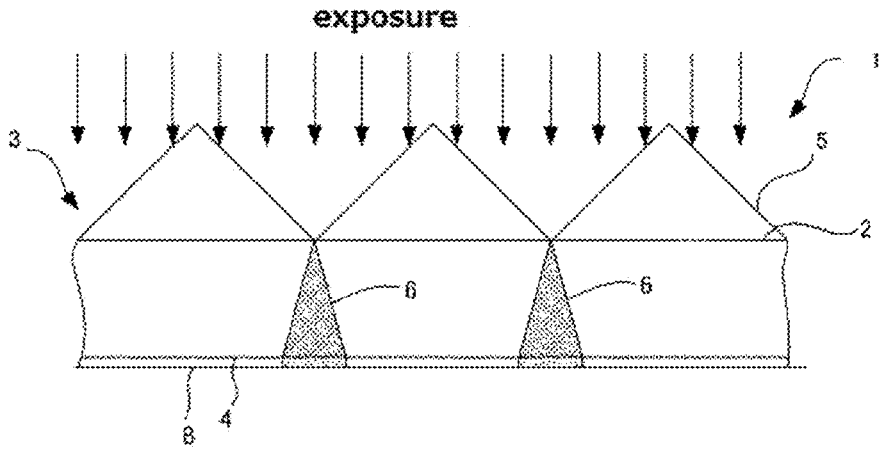
FIG. 8B is a schematic sectional view showing an exposure state of the prism sheet A having the positive photosensitive layer 8 on the second surface 4 of the support 2.

As illustrated in FIG. 8B, the positive photosensitive layer was exposed to ultraviolet rays through UV irradiation in a direction parallel to a normal direction to the second flat surface 4 from a side closer to the first surface 3 having the irregular portion 5 of the support 2 with a parallel beam irradiator (Mask aligner M-2L available from MIKASA CO. LTD). Each light-unpassing portion (low luminous-flux-density portion) is indicated by numeral 6 in FIG. 8B.

Figure 8C:
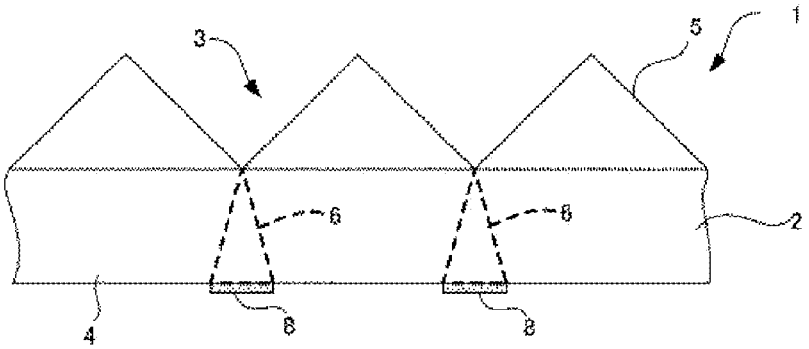
FIG. 8C is a schematic sectional view of the prism sheet A from which the exposed portion is washed out after the exposure step of FIG. 8B.

The exposed portion of the positive photosensitive layer was then washed out using the alkaline developer prepared as described above. As illustrated in FIG. 8C, the support 2 was produced, which had the positive photosensitive layer 8 on part of the second surface 4 of the support 2 corresponding to a surface of the light-unpassing portion 6.

Figure 8D:
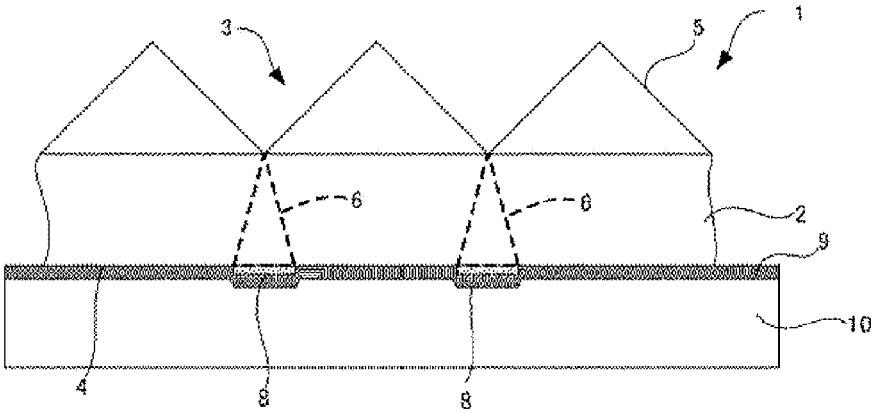
FIG. 8D is a schematic sectional view of the prism sheet A having a white reflective sheet 10 disposed on the support 2.
Figure 8E:
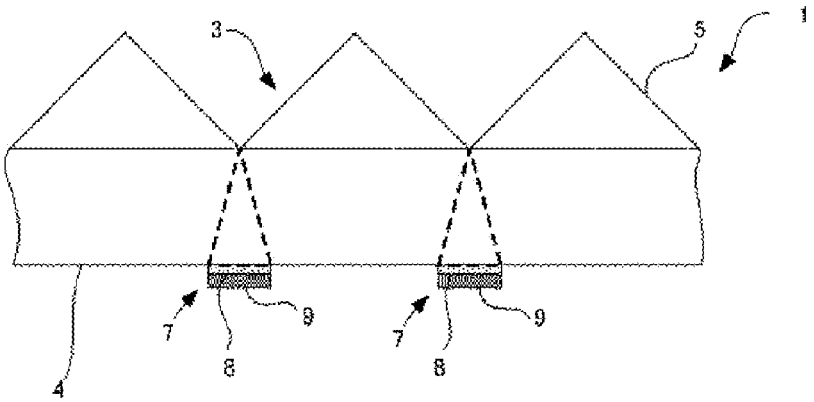
FIG. 8E is a schematic sectional view of the prism sheet A in a state where the white reflective sheet is separated from the support 2.

As illustrated in FIG. 8D, the white reflective sheet 10 having the white reflective layer 9 produced as described above was disposed on the second surface 4 having the positive photosensitive layer 8 of the support 2, on part of which the positive photosensitive layer 8 was provided as described above, such that the white reflective layer 9 was in contact with the sticky positive photosensitive layer 8 and the second surface 4, and the white reflective sheet 10 was thermally laminated to the positive photosensitive layer 8 by a laminator at a speed of 0.5 m/min and a heating temperature of 80° C. As illustrated in FIG. 8E, the white reflective sheet 10 was then separated from the support 2. As a result, the support 2 was produced, which had the white reflective layer 9 transferred to each portion having the positive photosensitive layer 8 in a stripe pattern having a width of 12 μm, and thus the prism sheet B was formed. The white reflective layer 9 served as a sidelobe preventer 7, and had a light-reflectance of 70%.

[Production of Prism Sheet C]

The coating liquid for a prism layer prepared as described above was applied onto a first surface of a 25 μm thick transparent PET support, of which both sides were subjected to pre-adhesion treatment, such that the dry mass was 14 g/m$^2$, and the prism layer was then dried for 1 min at 80° C. The prism layer was then pressed against a metal mold (die), on which the prism shapes were carved in a stripe pattern at a pitch (bottom length) of 50 μm, each prism shape having a section of an isosceles triangle with a vertical angle of 110°. The prism layer in such a pressed state was exposed to light with a high-pressure mercury vapor lamp to cure the prism layer. The resultant film was separated from the die, thereby a prism sheet C (a support having an irregular portion thereon) was produced.

(Production of Backlight Unit)

Each of the above-described prism sheets was disposed on a planar light source that was detached from a commercially available liquid crystal display, so that a backlight unit was produced.

The prism sheet A having the vertical angle of 90°, the prism sheet B having the vertical angle of 90° as an optical sheet partially having a plurality of light-reflective sidelobe preventers 7, and the prism sheet C having the vertical angle of 110° were disposed to satisfy the contents listed in Table 9.

(Method of Evaluation of Front Brightness)

Evaluation of front brightness corresponds to measurement of transmittance in a front direction in Example 1.

The luminous intensity was measured with a luminance meter (BM-7 available from TOPCON CORPORATION) set above the planar light source of the backlight unit having each prism sheet. Brightness was expressed using a magnification of front brightness for the backlight unit having each optical sheet assuming that the front brightness was 1 for a backlight unit having only the planar light source without the prism sheet. The brightness was classified as follow.

A: 1.3 or more

B: 1.1 to less than 1.3

C: less than 1.1

(Measurement of Output Angle Distribution of Backlight Light)

The luminous intensity was measured with a luminance meter (BM-7 available from TOPCON CORPORATION) for a backlight unit provided with each prism sheet.

The angular distribution of the luminous intensity of light emitted from the prism sheet was measured with a photoreceptor that scans the prism sheet at 5° intervals within ±85° with respect to a light condensing direction of the prism sheet assuming that the front direction was 0°. The average quantity of light measured at an output angle in the range of 50° to 85° was obtained for each backlight unit, and listed in Table 9.

Figure 9:
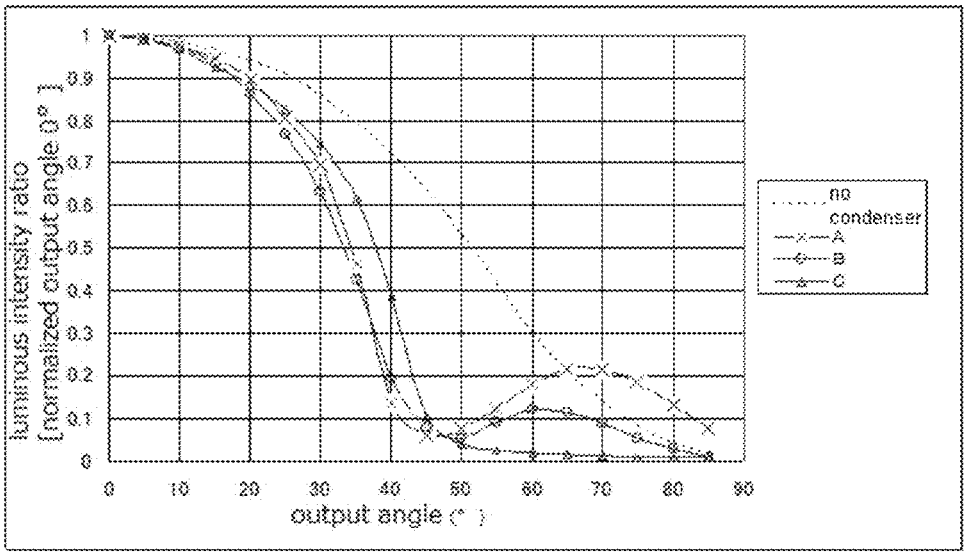
FIG. 9 is a graph showing a relationship between luminous intensity and an output angle, the luminous intensity being normalized with reference to the luminous intensity (cd) measured at the front (0°) for each prism sheet.

FIG. 9 illustrates a relationship between the luminous intensity and the output angle, the relationship being normalized by the luminous intensity measured at the front)(0° for each prism sheet.

(Production of Liquid Crystal Display)

Each of liquid crystal displays (displays 20 to 24) was assembled such that a liquid crystal cell and a polarizing plate each satisfy the contents listed in Table 8 and such that the backlight unit incorporating each prism sheet satisfies the contents listed in Table 9.

A TN-mode liquid crystal cell (Δnd: 410 nm, twist angle: 90°) including an RGBW color filter having a configuration as illustrated in FIG. 4-1 was prepared, and a polarizing plate equivalent to one of the polarizing plates produced as described above was bonded to each of the top and bottom of the liquid crystal cell, thereby liquid crystal displays each having a configuration equivalent to that illustrated in FIG. 3-1 were produced. In this assembling process, the polarizing plates had an E-mode arrangement.

Each prism sheet, of which the convex portion faced the liquid crystal cell, was disposed such that the light-condensing direction thereof was a vertical or horizontal direction as shown in Tables 8 and 9.

Table 9 shows the results of the front brightness and downward grayscale inversion in Example 1.

TABLE 8

| | Configuration | Control of applied voltage | Arrangement of polarizing plates | Polarizing plate on each of viewing and rear sides | |
|---|---|---|---|---|---|
| Display 20 | RGBW | Performed in the same way as in Example 4 | E-mode | Polarizing plate 1 (retardation film 4) | Example |
| Display 21 | | | | | Example |
| Display 22 | | | | | Example |
| Display 23 | | | | | Example |
| Display 24 | | | | | Example |

TABLE 9

| | Prism sheet | | | Performance | | |
|---|---|---|---|---|---|---|
| | Sheet | Light condensing direction | 50° to 85° Average quantity of light | Front brightness | Downward grayscale inversion, R value | |
| Display 20 | None | Not condensed | 22% | C | E | Example |
| Display 21 | A | Vertical | 15% | B | D | Example |
| Display 22 | B | Vertical | 6.90% | A | C | Example |

TABLE 9-continued

| | Prism sheet | | | Performance | | |
|---|---|---|---|---|---|---|
| | Sheet | Light condensing direction | 50° to 85° Average quantity of light | Front brightness | Downward grayscale inversion, R value | |
| Display 23 | C | Vertical | 1.80% | A | C | Example |
| Display 24 | C | Horizontal | 1.80% | A | E | Example |

Tables 8 and 9 reveal that the displays 22 and 23, each having a vertical light-condensing direction and including the prism sheets B and C, respectively, have particularly excellent performance.

As illustrated in FIG. 9, it is believed that the displays 22 and 23 each have an improved level of downward grayscale inversion compared with diffusive backlight light since the quantity of light extremely decreases at a polar angle larger than downward 30°, i.e., in a direction tilting from a direction of an azimuth of 270° and a polar angle of 30°.

The present disclosure relates to the subject matter contained in Japanese Patent Application No. 218158/2011 filed on Sep. 30, 2011, and Japanese Patent Application No. 134571/2012 filed on Jun. 14, 2012, which are expressly incorporated herein by reference in their entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A liquid crystal display, comprising:

a pair of polarizers;

a liquid crystal cell comprising a pair of substrates having electrodes defining pixels on at least one of opposed surfaces of the substrates, and a liquid crystal layer disposed between the pair of substrates, the liquid crystal layer being twist-aligned at a twist angle of 90° or less; and retardation films each being disposed between each of the pair of polarizers and the liquid crystal cell, the liquid crystal cell having pixel groups, each group comprising a red (R) pixel, a green (G) pixel, a blue (B) pixel, and a white (W) pixel, the liquid crystal display further comprising drive circuitry that applies a voltage $V_{RGB}$ and a voltage $V_W$ satisfying the formulae (ia) and (iia) or (ib) and (iib) between electrodes defining the G pixel and between electrodes defining the W pixel, respectively, depending on a grayscale level L (where L satisfies $0 \leq L \leq 1$) in grayscale where substantially the same voltage $V_{RGB}$ is applied between electrodes defining each of the R, G, and B pixels:

$$\text{for } 0<L\leq 0.03,\ T_G=0 \text{ and } T_W=2*L, \quad \text{(ia)}$$

$$\text{for } 0.03<L\leq 0.3,\ 0.05<T_W/(T_G-0.03)<0.86; \quad \text{(iia)}$$

$$\text{for } 0<L\leq 0.03,\ T_W=0 \text{ and } T_G=2*L, \quad \text{(ib)}$$

$$\text{for } 0.03<L\leq 0.3,\ 0.05<T_G/(T_W-0.03)<0.86, \quad \text{(iib)}$$

where $T_G$ and $T_W$ each represent normalized transmittance obtained through normalization of transmittance of each of the G and W pixels assuming that white brightness in a normal direction to a display surface of the liquid crystal display is 1.

2. The liquid crystal display according to claim 1, wherein the retardation film is a laminated film comprising a support and an optically-anisotropic layer comprising discotic liquid crystal fixed in a hybrid alignment state.

3. The liquid crystal display according to claim 1, wherein the twist angle of the liquid crystal layer is 90°.

4. The liquid crystal display according to claim 1, wherein the liquid crystal display comprises a backlight unit comprising a surface light source and a condenser sheet, and when the quantity of light emitted from the backlight unit is measured, the average quantity of light at an output angle in a range of 50° to 85° is 12% or less of the quantity of light in a normal direction to a screen of the liquid crystal display, the output angle tilting toward a vertical or horizontal direction on the screen of the liquid crystal display with respect to the normal to the screen of the liquid crystal display as viewed from a viewer.

5. The liquid crystal display according to claim 4, wherein the condenser sheet is a prism sheet having convex portions facing the liquid crystal cell.

6. The liquid crystal display according to claim 4, wherein the twist angle of the liquid crystal layer is 90°, and the condenser sheet is a prism sheet having convex portions facing the liquid crystal cell.

7. The liquid crystal display according to claim 4, wherein the retardation film comprises a single polymer film, and a refractive index nx in an in-plane maximum direction, a refractive index ny in a direction perpendicular to nx, and a refractive index nz in a thickness direction satisfy nx>ny>nz.

8. The liquid crystal display according to claim 1, wherein the retardation film comprises a single polymer film, and a refractive index nx in an in-plane maximum direction, a refractive index ny in a direction perpendicular to nx, and a refractive index nz in a thickness direction satisfy nx>ny>nz.

9. The liquid crystal display according to claim 1, wherein the twist angle of the liquid crystal layer is 90°, and the liquid crystal display comprises a backlight unit comprising a surface light source and a condenser sheet, and when the quantity of light emitted from the backlight unit is measured, the average quantity of light at an output angle in a range of 50° to 85° is 12% or less of the quantity of light in a normal direction to a screen of the liquid crystal display, the output angle tilting toward a vertical or horizontal direction on the screen of the liquid crystal display with respect to the normal to the screen of the liquid crystal display as viewed from a viewer.

10. The liquid crystal display according to claim 1, wherein the twist angle of the liquid crystal layer is 90°, and the retardation film comprises a single polymer film, and a refractive index nx in an in-plane maximum direction, a refractive index ny in a direction perpendicular to nx, and a refractive index nz in a thickness direction satisfy nx>ny>nz.

11. The liquid crystal display according to claim 1, wherein the liquid crystal display comprises a backlight unit comprising a surface light source and a condenser sheet, and when the quantity of light emitted from the backlight unit is measured, the average quantity of light at an output angle in a range of 50° to 85° is 12% or less of the quantity of light in a normal direction to a screen of the liquid crystal display, the output angle tilting toward a vertical or horizontal direction on the screen of the liquid crystal display with respect to the normal to the screen of the liquid crystal display as viewed from a viewer, the retardation film comprises a single polymer film, a refractive index nx in an in-plane maximum direction, and a refractive index ny in a direction perpendicular to nx, and a refractive index nz in a thickness direction satisfy nx>ny>nz, and the condenser sheet is a prism sheet having convex portions facing the liquid crystal cell.

12. The liquid crystal display according to claim 1, wherein the retardation film is a laminated film comprising a support and an optically-anisotropic layer comprising discotic liquid crystal fixed in a hybrid alignment state, and the twist angle of the liquid crystal layer is 90°.

13. A method of driving a liquid crystal display comprising a pair of polarizers, a liquid crystal cell comprising a pair of substrates having electrodes defining pixels on at least one of opposed surfaces of the substrates, and liquid crystal layer disposed between the pair of substrates, the liquid crystal layer being twist-aligned at a twist angle of 90° or less, and retardation films each being disposed between each of the pair of polarizers and the liquid crystal cell, the liquid crystal cell having pixel groups, each group comprising a red (R) pixel, a green (G) pixel, a blue (B) pixel, and a white (W) pixel, wherein a voltage $V_{RGB}$ and a voltage $V_W$ each satisfying the formulae (ia) and (iia) or (ib) and (iib) are applied between electrodes defining the G pixel and between electrodes defining the W pixel, respectively, depending on a grayscale level L (where L satisfies in grayscale where substantially the same voltage $V_{RGB}$ is applied between electrodes defining each of the R, G, and B pixels:

$$\text{for } 0<L\leq 0.03,\ T_G=0 \text{ and } T_W=2*L, \quad \text{(ia)}$$

$$\text{for } 0.03<L\leq 0.3,\ 0.05<T_W/(T_G-0.03)<0.86; \quad \text{(iia)}$$

$$\text{for } 0<L\leq 0.03,\ T_W=0 \text{ and } T_G=2*L, \quad \text{(ib)}$$

$$\text{for } 0.03<L\leq 0.3,\ 0.05<T_G/(T_W-0.03)<0.86, \quad \text{(iib)}$$

where $T_G$ and $T_W$ each represent normalized transmittance obtained through normalization of transmittance of each of the G and W pixels assuming that white brightness in a normal direction to a display surface of the liquid crystal display is 1.

* * * * *